US009823031B2

(12) United States Patent
Robbins et al.

(10) Patent No.: US 9,823,031 B2
(45) Date of Patent: Nov. 21, 2017

(54) MODULAR AUTOMATIC OR SEMI-AUTOMATIC RIFLE

(75) Inventors: Laurance Robbins, Plainville, CT (US); Kevin Audibert, Wolcott, CT (US); Kevin Langevin, Berlin, CT (US)

(73) Assignee: COLT'S MANUFACTURING IP HOLDING COMPANY LLC, West Hartford, CT (US)

( * ) Notice: Subject to any disclaimer, the term of this patent is extended or adjusted under 35 U.S.C. 154(b) by 337 days.

(21) Appl. No.: 12/898,610

(22) Filed: Oct. 5, 2010

(65) Prior Publication Data

US 2012/0167433 A1 Jul. 5, 2012

Related U.S. Application Data

(60) Provisional application No. 61/248,786, filed on Oct. 5, 2009.

(51) Int. Cl.
*F41A 3/66* (2006.01)
*F41A 11/02* (2006.01)

(52) U.S. Cl.
CPC ..... *F41A 3/66* (2013.01); *F41A 11/02* (2013.01)

(58) Field of Classification Search
CPC ..... F41A 11/02; F41A 3/66
USPC ..... 42/75.02, 77
See application file for complete search history.

(56) References Cited

U.S. PATENT DOCUMENTS 2,447,091 A 8/1948 Pope
3,026,777 A 3/1962 Wooderson
3,183,616 A 5/1965 Gandy
3,198,076 A 8/1965 Stoner
3,618,457 A 11/1971 Miller
3,771,415 A 11/1973 Into et al.
3,776,095 A 12/1973 Atchisson
4,057,003 A 11/1977 Atchisson
(Continued)

FOREIGN PATENT DOCUMENTS

CA 2687510 3/2010
WO WO8403937 10/1984
(Continued)

OTHER PUBLICATIONS

Brownells, Catalog #6 1911 Catalog—2009-2012 (Examiners Office) p. 3. Fourth from the top (Tactical Carbine) Flat top receiver with cooling slots angled towards teh buttstock end of firearm.
(Continued)

*Primary Examiner* — Stephen M Johnson
*Assistant Examiner* — Benjamin Gomberg
(74) *Attorney, Agent, or Firm* — Cantor Colburn LLP

(57) ABSTRACT

A modular automatic or semiautomatic rifle. The rifle has a lower receiver assembly having a fire control assembly for firing the rifle. An upper receiver assembly is provided with a frame and a bolt carrier assembly configured for firing bullets of a predetermined caliber. The lower receiver has a mating interface configured for operably joining the lower receiver assembly to the upper receiver assembly, and for operably joining the lower receiver assembly to another upper receiver assembly different from the upper receiver assembly configured for firing bullets of the predetermined caliber. The other upper receiver assembly has a different frame and different bolt carrier assembly configured for firing bullets of a different predetermined caliber.

17 Claims, 33 Drawing Sheets

(56) References Cited

U.S. PATENT DOCUMENTS

| | | | | |
|---|---|---|---|---|
| 4,058,922 | A | 11/1977 | Elbe et al. | |
| 4,142,314 | A | 3/1979 | Foote | |
| 4,253,377 | A | 3/1981 | Arnett | |
| 4,288,938 | A | 9/1981 | Kahn | |
| 4,297,800 | A | 11/1981 | Atchisson | |
| 4,297,801 | A | 11/1981 | Kahn | |
| 4,433,610 | A | 2/1984 | Tatro | |
| 4,448,109 | A | 5/1984 | Johnson | |
| 4,475,438 | A | 10/1984 | Sullivan | |
| 4,531,446 | A | 7/1985 | Van Voorhees | |
| 4,536,982 | A | 8/1985 | Bredbury et al. | |
| 4,644,930 | A | 2/1987 | Mainhardt | |
| 4,648,192 | A * | 3/1987 | Harness | 42/77 |
| 4,658,702 | A | 4/1987 | Tatro | |
| 4,663,875 | A | 5/1987 | Tatro | |
| 4,920,678 | A | 5/1990 | Brown | |
| 4,937,964 | A | 7/1990 | Crandall | |
| 5,046,275 | A | 9/1991 | Brown | |
| 5,115,588 | A | 5/1992 | Bronsart et al. | |
| 5,187,312 | A | 2/1993 | Osborne | |
| 5,228,887 | A | 7/1993 | Mayer | |
| 5,343,650 | A | 9/1994 | Swan | |
| 5,487,233 | A | 1/1996 | Jewell | |
| 5,501,134 | A | 3/1996 | Milazzo et al. | |
| 5,623,114 | A | 4/1997 | Soper | |
| 5,726,377 | A | 3/1998 | Harris et al. | |
| 5,760,328 | A | 6/1998 | Robbins | |
| 5,824,943 | A | 10/1998 | Guhring et al. | |
| 5,832,911 | A | 11/1998 | Mayville et al. | |
| 5,881,485 | A | 3/1999 | Milazzo | |
| 5,900,577 | A | 5/1999 | Robinson et al. | |
| 5,924,231 | A | 7/1999 | Kidd | |
| 6,070,352 | A | 6/2000 | Daigle | |
| 6,131,324 | A | 10/2000 | Jewell | |
| 6,212,814 | B1 | 4/2001 | Lambie | |
| 6,250,194 | B1 | 6/2001 | Brandl | |
| 6,293,040 | B1 * | 9/2001 | Luth | 42/75.01 |
| 6,393,751 | B1 | 5/2002 | Liebenberg | |
| 6,493,979 | B2 | 12/2002 | Katzmaier | |
| 6,536,152 | B1 | 3/2003 | Wisz | |
| 6,606,812 | B1 | 8/2003 | Gwinn, Jr. | |
| 6,722,072 | B1 | 4/2004 | McCormick | |
| 6,772,548 | B1 | 8/2004 | Power | |
| 6,931,775 | B2 | 8/2005 | Burnett | |
| 7,059,076 | B2 | 6/2006 | Stoner et al. | |
| 7,131,228 | B2 | 11/2006 | Hochstrate et al. | |
| 7,162,824 | B1 | 1/2007 | McCormick | |
| 7,293,385 | B2 | 11/2007 | McCormick | |
| 7,302,881 | B1 | 12/2007 | Tertin | |
| 7,331,136 | B2 | 2/2008 | Geissele | |
| 7,363,741 | B2 | 4/2008 | DeSomma et al. | |
| 7,421,937 | B1 | 9/2008 | Gangl | |
| 7,444,775 | B1 * | 11/2008 | Schuetz | 42/76.01 |
| 7,574,823 | B2 | 8/2009 | Nakayama | |
| 7,584,567 | B1 | 9/2009 | DeSomma et al. | |
| 7,596,900 | B2 | 10/2009 | Robinson et al. | |
| 7,600,338 | B2 | 10/2009 | Geissele | |
| 7,610,844 | B2 | 11/2009 | Kuczynko et al. | |
| 7,631,453 | B2 | 12/2009 | Longueira | |
| 7,654,187 | B2 | 2/2010 | Hochstrate et al. | |
| 7,712,241 | B2 | 5/2010 | Teetzel et al. | |
| 7,716,865 | B2 | 5/2010 | Daniel et al. | |
| 7,775,150 | B2 | 8/2010 | Hochstrate et al. | |
| 7,810,271 | B2 | 10/2010 | Patel | |
| 7,934,447 | B2 | 5/2011 | Kuczynko et al. | |
| 7,938,055 | B2 | 5/2011 | Hochstrate et al. | |
| 7,966,761 | B1 | 6/2011 | Kuczynko et al. | |
| 7,971,379 | B2 | 7/2011 | Robinson et al. | |
| 7,971,382 | B2 | 7/2011 | Robinson et al. | |
| 8,015,908 | B2 | 9/2011 | Kline et al. | |
| 8,028,459 | B2 | 10/2011 | Williams | |
| 8,028,460 | B2 | 10/2011 | Williams | |
| D649,093 | S | 11/2011 | Yokoi et al. | |
| D649,498 | S | 11/2011 | Sowa et al. | |
| 8,051,595 | B2 | 11/2011 | Hochstrate et al. | |
| 8,074,556 | B2 | 12/2011 | Bantle et al. | |
| D651,948 | S | 1/2012 | Fukui et al. | |
| 8,087,194 | B1 | 1/2012 | Vuksanovich | |
| 8,141,287 | B2 | 3/2012 | Dubois | |
| 8,234,808 | B2 | 8/2012 | Lewis et al. | |
| 8,234,809 | B2 | 8/2012 | Daniel | |
| 8,245,626 | B2 | 8/2012 | Langevin | |
| 8,336,243 | B2 | 12/2012 | Langevin et al. | |
| 8,453,364 | B2 | 6/2013 | Kucynko | |
| 2003/0101631 | A1 | 6/2003 | Fitzpatrick et al. | |
| 2005/0188827 | A1 | 9/2005 | McNulty, Jr. | |
| 2005/0241470 | A1 | 11/2005 | Hochstrate et al. | |
| 2005/0262752 | A1 | 12/2005 | Robinson | |
| 2005/0265513 | A1 | 12/2005 | Dahlback et al. | |
| 2006/0010748 | A1 | 1/2006 | Stoner et al. | |
| 2006/0026883 | A1 | 2/2006 | Hochstrate et al. | |
| 2006/0065112 | A1 | 3/2006 | Kuczynko et al. | |
| 2006/0156606 | A1 | 7/2006 | Robinson et al. | |
| 2006/0236582 | A1 | 10/2006 | Lewis et al. | |
| 2006/0254414 | A1 | 11/2006 | Kuczynko et al. | |
| 2007/0033851 | A1 | 2/2007 | Hochstrate et al. | |
| 2007/0051236 | A1 | 3/2007 | Groves et al. | |
| 2007/0199435 | A1 | 8/2007 | Hochstrate et al. | |
| 2008/0000128 | A1 | 1/2008 | Newman | |
| 2008/0301994 | A1 | 12/2008 | Langevin et al. | |
| 2009/0000173 | A1 | 1/2009 | Robinson | |
| 2009/0007477 | A1 | 1/2009 | Robinson | |
| 2009/0031605 | A1 | 2/2009 | Robinson | |
| 2009/0031606 | A1 | 2/2009 | Robinson et al. | |
| 2009/0031607 | A1 | 2/2009 | Robinson | |
| 2009/0126249 | A1 | 5/2009 | Crommett | |
| 2009/0178325 | A1 | 7/2009 | Veilleux | |
| 2009/0183414 | A1 | 7/2009 | Geissele | |
| 2009/0188145 | A1 | 7/2009 | Fluhr et al. | |
| 2009/0277067 | A1 | 11/2009 | Gregg | |
| 2010/0000138 | A1 | 1/2010 | Brown | |
| 2010/0088523 | A1 | 4/2010 | Wooten | |
| 2010/0095833 | A1 | 4/2010 | Gavage | |
| 2010/0126054 | A1 | 5/2010 | Daniel et al. | |
| 2010/0186277 | A1 | 7/2010 | Beckmann | |
| 2010/0229445 | A1 | 9/2010 | Patel | |
| 2010/0282064 | A1 | 11/2010 | Bantle et al. | |
| 2010/0300277 | A1 | 12/2010 | Hochstrate et al. | |
| 2011/0056107 | A1 | 3/2011 | Underwood | |
| 2011/0061281 | A1 | 3/2011 | Kapusta et al. | |
| 2011/0119981 | A1 * | 5/2011 | Larue | 42/71.01 |
| 2011/0131857 | A1 | 6/2011 | Kuczynko et al. | |
| 2011/0173862 | A1 | 7/2011 | Williams | |
| 2011/0265640 | A1 | 11/2011 | Kuczynko et al. | |
| 2011/0283585 | A1 | 11/2011 | Cabahug et al. | |
| 2012/0132068 | A1 | 5/2012 | Kucynko | |
| 2012/0151813 | A1 | 6/2012 | Brown | |
| 2012/0152104 | A1 | 6/2012 | Audibert et al. | |
| 2012/0152106 | A1 | 6/2012 | Langevin | |
| 2012/0167433 | A1 | 7/2012 | Robbins et al. | |
| 2012/0297656 | A1 | 11/2012 | Langevin et al. | |
| 2016/0209136 | A1 | 7/2016 | Schuetz | |

FOREIGN PATENT DOCUMENTS

| | | | |
|---|---|---|---|
| WO | WO0114818 | | 3/2001 |
| WO | 02068894 | A1 | 9/2002 |
| WO | 2006137874 | | 12/2006 |

OTHER PUBLICATIONS

Jeff W. Zimba, The Hydra Modular Weapons System from MGI, The Small Arms Review, vol. 10 No. 8 • May 2007.

David Crane, Bushmaster .338 Lapua Magnum MCR (Multi Caliber Rifle): Semi-Auto .338 Lapua Magnum AR Anti-Materiel/Sniper Rifle for Long-Range Interdiction. Will it live?, http://www.defensereview.com/bushmaster-338-lapua-magnum-mcr-modular-combat-rifle-semi-auto-338-lapua-magnum-anti-materielsniper-rifle-for-long-range-interdiction-will-it-live/.

Ceska Zbrojovka, Military 2010 Catalogue.

David Crane, New Cobb MCR (Multi-Caliber Rifle) Weapon System is Mil/LE/Civilian Ready, http://www.defensereview.com/new-

(56) References Cited

OTHER PUBLICATIONS cobb-mcr-multi-caliber-rifle-weapon-system-is-millecivilian-ready/.
XCLR Robinson Firearms Spec Sheet, www.robarm.com/resources/products/xcrlstd/index.aspx.
Brownells, Catalog #6 AR-15/M16 & AR-Type. 308 Catalog—2010-2011 (Examiner's Office).
International Preliminary Report on Patentability mailed Apr. 19, 2012 for International Application No. PCT/US2010/051533, International filing date Oct. 5, 2010; Report Issued Apr. 11, 2012.
International Search Report dated Nov. 29, 2010 for International Application No. PCT/US2010/051533.
Quad-Rail Handguard (2 pages) http://web.archive.org/web/20010908173536/http://www.cmore.com (dated Jul. 24, 2008).
Written Opinion dated Nov. 29, 2010 for International Application No. PCT/US2010/051533.
International Search Report mailed Jan. 30, 2013 for International Application No. PCT/US2012/033220 filed Apr. 12, 2012. All art referenced is cited herein.
Written Opinion of the International Searching Authority mailed Jan. 30, 2013 for International Application No. PCT/US2012/033220 filed Apr. 12, 2012.
Supplementary European Search Report mailed Jul. 29, 2014 for International Application No. PCT/US2012/033220.
Israeli Patent Applications Nos. 211,661, 218,857, 228,814 and 2,281 Office Action.
Supplementary European Search Report for EP Application No. 10 82 2559.
Non-Final Office Action dated May 9, 2017 for U.S. Appl. No. 14/968,139.

* cited by examiner

FIG. 18A
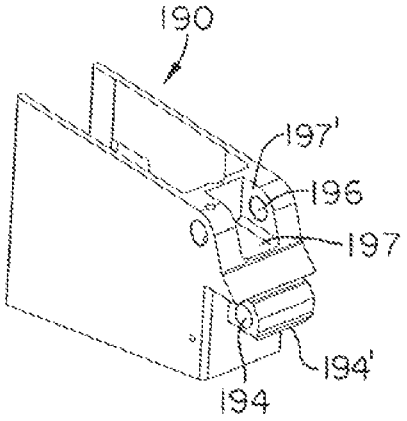
FIG. 18B
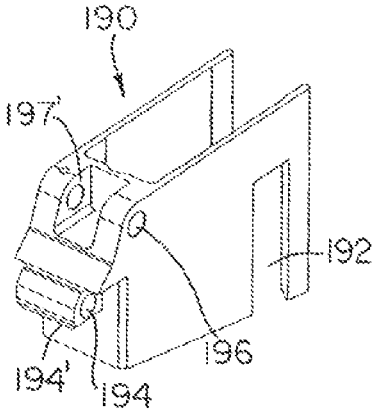
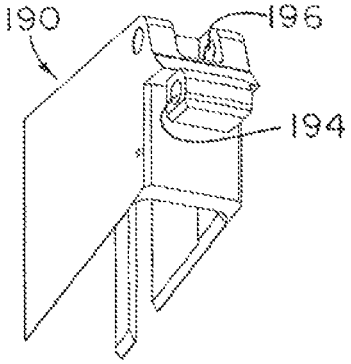
FIG. 18C
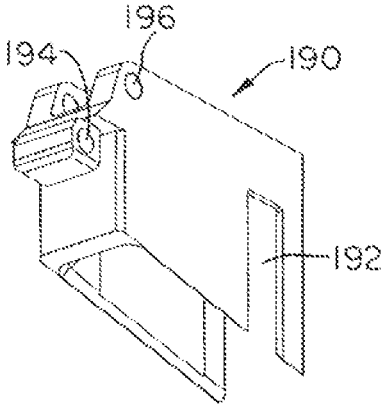
FIG. 18D

MODULAR AUTOMATIC OR SEMI-AUTOMATIC RIFLE

CROSS REFERENCE TO RELATED APPLICATION

This application claims the benefit of U.S. Provisional Application No. 61/248,786, filed Oct. 5, 2009 which is incorporated in its entirety herein.

BACKGROUND

1. Field of the Disclosed Embodiments

The disclosed embodiments relate to modular firearms and, more particularly, modular automatic or semi-automatic firearms.

2. Brief Description of Earlier Developments

There are conventional semi-automatic or automatic firearms that are capable of firing a single fixed type of round, for example, a 7.62-51 (a.k.a. 7.62 mm NATO) round and commercially known as a .308 caliber round. If a user of the firearm desires to fire a different round, for example, a 5.56 mm NATO round, for other purposes such as in an environment where 5.56 mm NATO ammunition is more readily available, or for training or to save cost, the user is generally required to have a separate firearm capable of firing the different round. As such, with a fixed round capability, the cost and maintenance requirements for the two separate firearm types are poor. As such, there is a desire to be able to have the advantages of a single firearm along with the advantages of firing multiple types of rounds.

BRIEF DESCRIPTION OF THE DRAWINGS

The foregoing aspects and other features of the exemplary embodiments are explained in the following description, taken in connection with the accompanying drawings, wherein:

FIGS. 18A-18D are isometric views of the 7.62 mm to 5.56 mm interface adapter;

DETAILED DESCRIPTION OF THE EXEMPLARY EMBODIMENT(S)

Figure 1A:
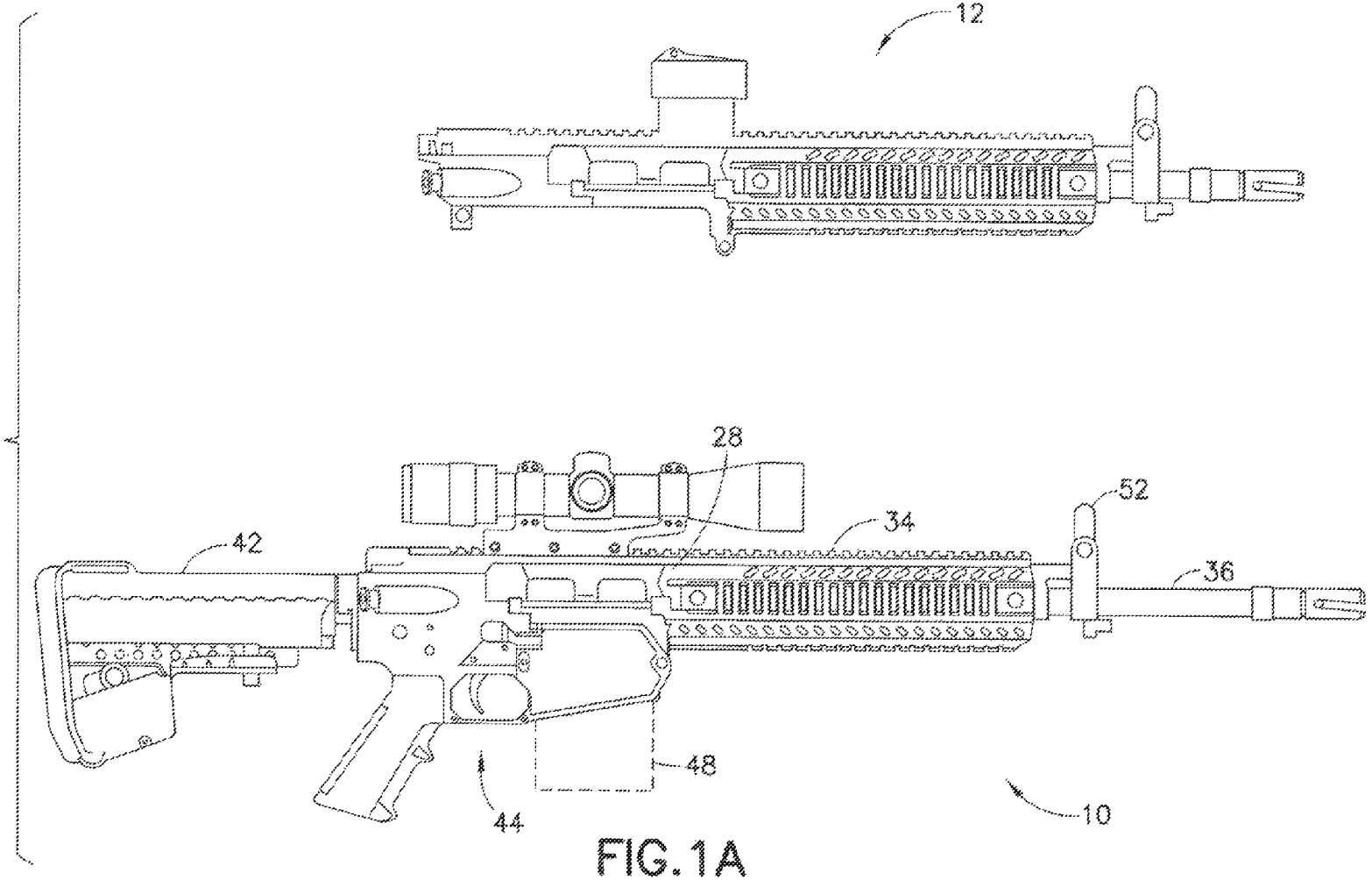
FIG. 1A is a side view of an exemplary embodiment of an automatic or semi-automatic firearm and system incorporating features as described further herein.

Referring to FIG. 1A, there is shown, a side elevation view of an automatic or semi-automatic firearm 10 capable of automatic or semiautomatic fire incorporating features in accordance with an exemplary embodiment of the present invention. Although the features of such embodiments will be described with reference to the embodiments shown in the drawings, it should be understood that the described features can be embodied in many alternate forms of embodiments. In addition, any suitable size, shape or type of elements or materials could be used.

Figure 1B:
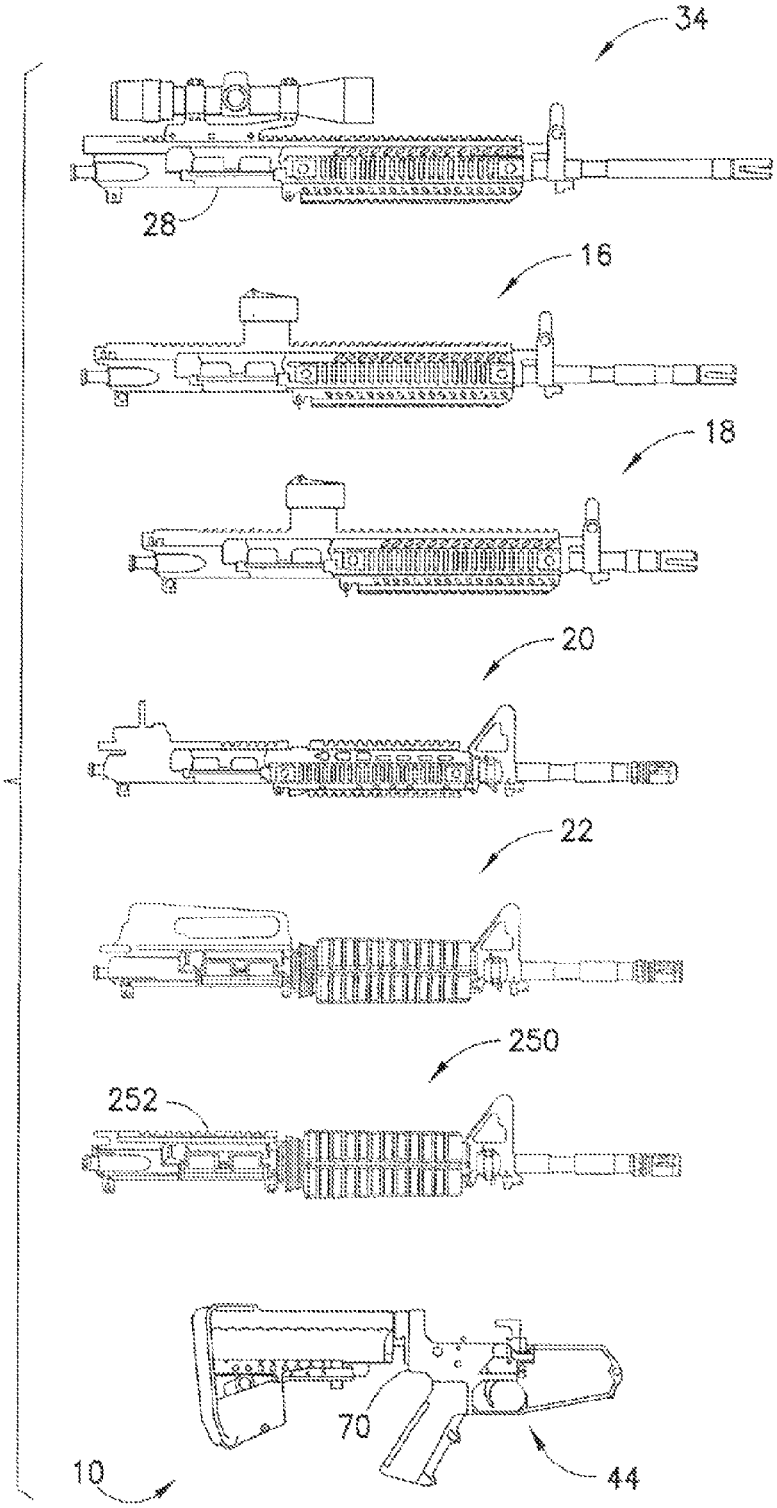
FIG. 1B is another side view of the automatic or semi-automatic firearm in FIG. 1A, illustrating the firearm and system components in a disassembled configuration.

Referring now to FIG. 1A, there is shown a side view of an automatic or semi-automatic firearm 10 incorporating features in accordance with an exemplary embodiment. Referring also to FIG. 1B, there is a side view of an automatic or semi-automatic firearm 10 incorporating features in accordance with an exemplary embodiment. Firearm 10 may be a modular carbine as a user level, mission configured, light weight modular, multi caliber weapon system. For example, the system may include a selectable upper receiver 34 (i.e. selectable from a group of different types of receivers that are interchangeable) and may be a multi caliber, multi operating system carbine/rifle. The system may be magazine fed and capable of firing in both automatic and semi automatic modes. Firearm or rifle 10 may allow a user to quickly reconfigure the weapon system to meet multiple mission requirements. For example, firearm 10 may be configured for calibers from 5.56 mm up to and including 7.62×51 mm NATO (and even larger if so desired) by changing the upper receiver group effected via a modular swap of the upper receiver. In alternate embodiments, different calibers may be provided or a common buffer system may be provided, or different buffer systems may be provided as will be described in greater detail below. As will be described, the configuration provides that by disengaging takedown, and pivot pins (effected for example with simple tools, no tools, armorer or gauges), a user may change from a 5.56 mm close quarters battle (CQB) short barrel configuration to a full length 7.62×51 mm extended range carbine (ERC) or rifle configuration without the need to re-zero or re target optics already mounted on the upper receiver assembly. Here, the weapon system may offer user level modular configuration capability and may reduce critical mission time loss and key technical personnel needs to execute weapon configuration changes. Rifle 10 may have a self contained approach that protects components of the operating system and may provide uninterrupted operability in multiple environments. Rifle 10, having a common lower receiver 44, may provide a single serial number weapon system that may be reconfigured into multiple carbine/caliber configurations without the use of special tools (e.g. tools other than what may be available to the user from the firearm itself). The modular capability may also apply to the operating system which may be configured for gas impingement, piston or hybrid gas/piston operating systems. Lower receiver 44 is shown in the exemplary embodiment configured as a 7.62×51 mm lower receiver (e.g. a configuration that accepts magazines for 7.62×51 mm ammunition) as well as magazines for smaller or different caliber ammunition, as will be further described). In alternate embodiments, any suitable caliber may be provided. Lower receiver 44 may be forged and may have a polymer A2 style grip and may be compatible with M4/M16 type magazines, trigger mechanisms and upper receiver/barrel assemblies with various barrel lengths, calibers and operating systems. Lower receiver 44 may have an ambidextrous bolt catch, magazine catch and/or selector level, for example, such as disclosed in U.S. patent application Ser. No. 11/351,631 filed Feb. 9, 2006, which is hereby incorporated by reference herein in its entirety. Upper receiver 34 may be forged and may be a modular one piece upper receiver and may have steel inserts in desired wear areas to extend service life. Barrel 36 may be a free floating barrel with different lengths, for example, 13", 16" and 18". Barrel 36 may be suppression capable, for example, utilizing an SEI Vortex R Compensator. Magazine 48 may be of polymer construction and compatible with M110 sniper weapon systems (SWS) metal magazines. Sight 52 may be an adjustable folding front sight offering mounting of multiple sights and ancillary devices without obstruction of a standard front sight post. Stock 42 may be a collapsible, multiple position EMod or IMod buttstock. Rifle 10 may have a Mil-Spec hard coat anodize finish and may have multiple camouflage colors and patterns. In the embodiment shown in FIG. 1A, upper receiver 34 is shown having a 16", 7.62×51 mm barrel and is interchangeable with upper receiver 12 having a 13" CQB 7.62×51 mm barrel. In alternate embodiments, any suitable combination of barrels or calibers may be provided, for example, 308 Win., 7-08 Rem., 243 Win, 22-250 Rem. or otherwise. In the embodiment shown in FIG. 1B, 7.62×51 mm universal or common lower receiver 44 is shown compatible with interchangeable upper receivers 34, 16, 18, 20, 22 where upper receiver 34 may be an ERC 16", 7.62×51 mm upper receiver and barrel assembly and where upper receiver 16 may be a Carbine 14.5", 7.62×51 mm upper receiver and barrel assembly and where upper receiver 18 may be a CQB 10.3", 7.62×51 mm upper receiver and barrel assembly and where upper receiver 20 may be an M4 7.62×51 mm upper receiver and barrel assembly with ARS and where upper receiver 22 may be any suitable Colt M4 7.62×51 mm upper receiver and barrel assembly. As will be described, in alternate embodiments, upper receiver assemblies 12, 34, 16, 18, 20, 22 may have one or more different calibers and may mate, for example with one or more different adapters (such as adapter 190 shown in FIG. 1C) that correspond to the different caliber upper receivers (or in alternate embodiments without an adapter as will be further described) to the common lower receiver 44. As will be described below, with the use of an adapter, for example adapter 190 in FIG. 1C, lower receiver 44 may be compatible with any suitable caliber upper receiver, for example, 5.56×45 mm NATO upper receiver 170, 230 or 250, 6.5 Grendel R, 6.8 mm Rem. SPC, 7.62×39 mm, .222 Rem. or otherwise. In the embodiment shown, each non 7.62×51 mm caliber may have a corresponding magazine well adapter, though in some alternate embodiments, a common magazine well adapter may be provided configured to mate more than one caliber magazine to the magazine well of the common lower receiver. As such, modular automatic or semiautomatic rifle 10 has a lower receiver assembly 44 having a fire control assembly 93. Upper receiver assembly 34 has frame 28 and a bolt carrier assembly configured for firing bullets of a predetermined caliber. Lower receiver assembly 44 is connectable to upper receiver assembly 34 and has a mating interface 70 configured for operably joining lower receiver assembly 44 to upper receiver assembly 34, and for operably joining the lower receiver assembly 44 to another of the different interchangeable upper receiver assemblies 250 (e.g. upper receiver assembly modules 12, 16, 18, 20, 22, 252, each of which is different from the upper receiver assembly 34) configured for firing bullets of different predetermined calibers and/or firing characteristics. The other upper receiver assembly 250 has a different frame 252 and different bolt carrier assembly configured for firing bullets of a different predetermined caliber. In the embodiments shown, upper receiver assembly 250 is selectable from different interchangeable upper receiver assemblies, each having a different predetermined characteristic determining a different predetermined caliber of bullets capable of being fired by the rifle. Adapter 190 may be provided connectable to the mating interface 70 and mating lower receiver assembly 44 the other upper receiver assembly 250.

Below, are specification tables A, B listing features of different exemplary upper receiver assembly modules such as shown in FIGS. 1A-1B, in accordance with an exemplary embodiment.

A

| CM901 | Carbine | CQB |
|---|---|---|
| Caliber | 7.62 × 51 NATO | 7.62 × 51 NATO |
| Dry Weight | 9.4 lbs | 9.1 lbs |
| Extended Length | 37.5" | 34.5" |

-continued

| A | | |
|---|---|---|
| CM901 | Carbine | CQB |
| Collapsed Length | 34.25" | 31.25" |
| Barrel Length | 16" | 13" |
| Barrel Type | Forged, H.B. | Forged, H.B. |
| Bore | Chromed, 4 Grooves, 1-12" twist, RH | Chromed, 4 Grooves, 1-12" twist, RH |
| Method of Operation | Gas; Direct System; Locking Bolt | Gas; Direct System; Locking Bolt |
| Ambidextrous | Yes | Yes |
| Muzzle Velocity | 2770 fps | 2540 fps |
| Effective Range | 700 m | 500 m |
| Front Sight | Adjustable Folding Front | Adjustable Folding Front |
| Cyclic Rate of Fire | 700-950 rpm | 700-1000 rpm- |

-continued

| A | | |
|---|---|---|
| CM901 | Carbine | CQB |
| Fire Control | Safe-Semi-Auto | Safe-Semi-Auto |
| Upper Receiver | Flat-Top, Monolithic Upper Receiver | Flat Top, Monolithic Upper Receiver |
| Design Maximum Operating Chamber Pressure | 70,000 psi max | 70,000 psi.max |
| Accuracy Specification with M118 | SUB 2 MOA | SUB 4 MOA |
| Accuracy Specification with 118LR | SUB 1 MOA | SUB 2.5" MOA |

| B | | | | |
|---|---|---|---|---|
| CM901 | Carbine | CQB | Commando | ERC |
| Caliber | 5.56 × 45 NATO | 5.56 × 45 NATO | 5.56 × 45 NATO | 5.56 × 45 NATO |
| Dry Weight | 7.5 lbs | 7.1 lbs | 7.3 lbs | 7.7 lbs |
| Extended Length | 35.25" | 31" | 32.25" | 36.75" |
| Collapsed Length | 32" | 27.8" | 29" | 33.5" |
| Barrel Length | 14.5" | 10.3" | 11.5" | 16" |
| Barrel Type | Broached, H.B. | Broached, H.B. | Broached, H.B. | Forged., H.B. |
| Bore | Chromed, 6 Grooves, 1-7" twist, RH | Chromed, 6 Grooves, 1-7" twist, RH | Chromed, 6 Grooves, 1-7" twist, RH | Chromed, 6 Grooves, 1-7" twist, RH |
| Method of Operation | Gas; Direct System; Locking Bolt | Gas; Direct System; Locking Bolt | Gas; Direct System; Locking Bolt | Gas; Direct System; Locking Bolt |
| Ambidextrous | Yes | Yes | Yes | Yes |
| Muzzle Velocity with M855 | 2785 fps | 2600 fps | 2610 fps | 2900 fps |
| Effective Range | 500 m | 400 m | 400 m | 600 m |
| Front Sight | Adjustable Folding Front | Adjustable Folding | Adjustable Folding Front | Adjustable Folding |
| Cyclic Rate of Fire | 700-950 rpm | 700-950 rpm | 700-950 rpm | 700-950 rpm |
| Fire Control | Safe-Semi-Auto | Safe-Semi-Auto | Safe-Semi-Auto | Safe-Semi-Auto |
| Upper Receiver | Flat Top, Monolithic Upper Receiver | Flat Top, Monolithic Upper Receiver | Flat Top, Monolithic Upper Receiver | Flat Top, Monolithic Upper Receiver |
| Design Maximum Operating Chamber Pressure | 66,000 psi max | 66,000 psi max | 66,000 psi max | 65,000 psi max |
| Accuracy Specification with M855 | SUB 4" MOA | SUB 6" MOA | SUB 6" MOA | SUB 4" MOA |
| Accuracy Specification with Match Grade Ammunition | SUB-1.5" MOA | SUB 4" MOA | SUB 4" MOA | SUB 1" MOA |

Table A shows an exemplary specification associated with 7.62×51 mm caliber. Table B shows an exemplary specification associated with 5.56×45 mm caliber. In alternate embodiments, any suitable caliber may be provided.

Figure 1D:
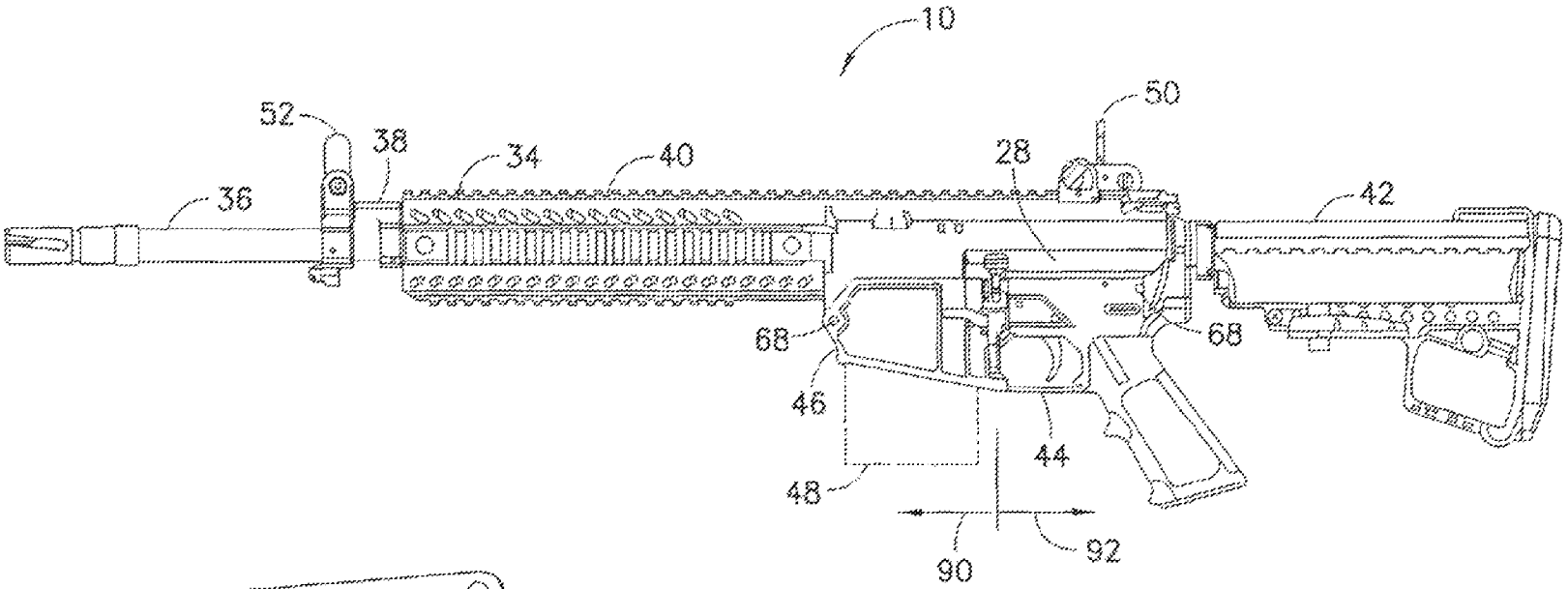
FIG. 1D is another side view of the automatic or semi-automatic firearm arranged in one configuration in accordance with the exemplary embodiment.
Figure 1C:
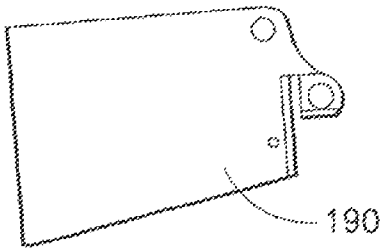
FIG. 1C is an elevation or side view of a portion of the firearm in accordance with an exemplary embodiment.
Figure 2:
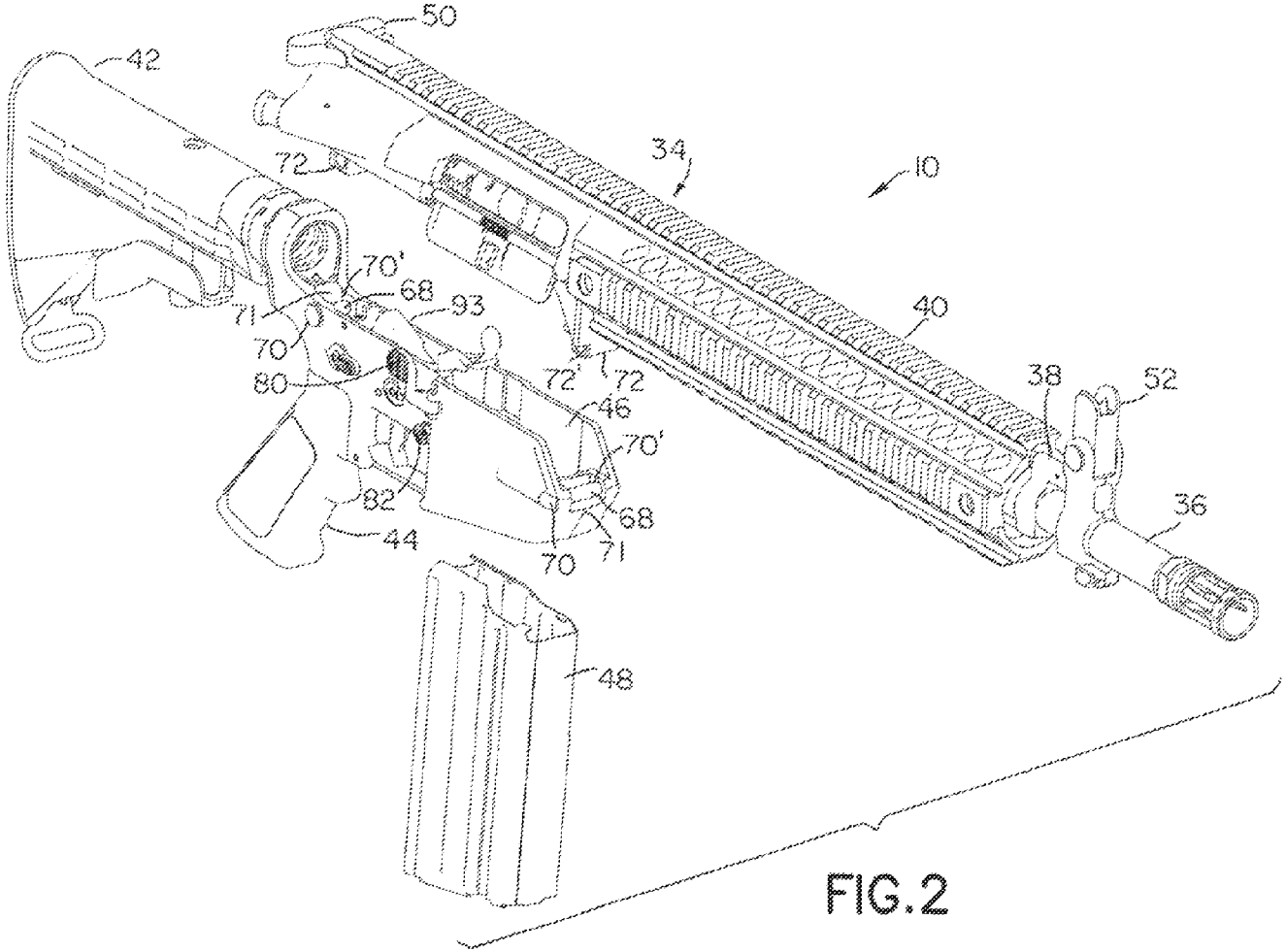
FIG. 2 is an exploded isometric view of the firearm shown in FIG. 1D.
Figure 3:
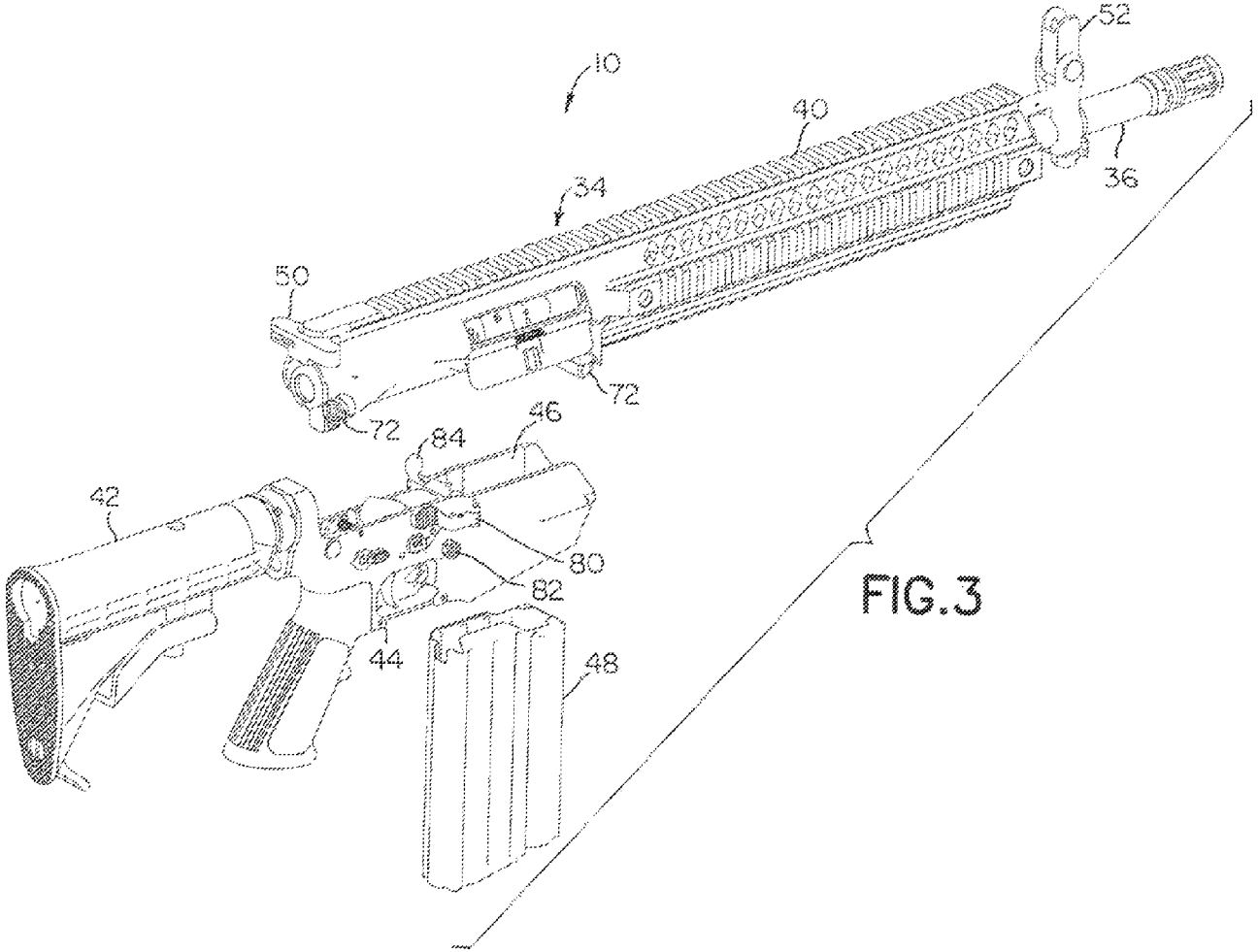
FIG. 3 is another exploded isometric view of the firearm shown in FIG. 1D.

Referring now to FIG. 1D, there is shown a side view of automatic or semi-automatic firearm 10 incorporating features in accordance with an exemplary embodiment. Referring also to FIG. 2, there is shown an exploded isometric view of the firearm shown in FIG. 1D. Referring also to FIG. 3, there is shown an exploded isometric view of the firearm shown in FIG. 1D. Firearm 10 may be indirect gas operated, like examples, such as the M-4 or M-16 firearms available from Colt Defense, LLC., similar commercial variants thereof and may have features as disclosed in U.S. patent application Ser. No. 11/231,063 filed Sep. 19, 2005, U.S. patent application Ser. No. 11/352,036 filed Feb. 9, 2006 or U.S. Patent Application No. 60/772,494 filed Feb. 9, 2006 or U.S. patent application Ser. No. 11/154,738 filed Jun. 16, 2005 or U.S. patent application Ser. No. 11/113,525 filed Apr. 25, 2005 all of which are hereby incorporated herein by reference in their entirety. Firearm 10 is illustrated as generally having a black rifle type configuration, the black rifle type configuration being the family of rifles developed by Eugene Stoner, for example, such as an M4 or M16 automatic firearm configuration. However, the features of the disclosed embodiments, as will be described below, are equally applicable to any desired type of automatic or semi-automatic firearm. Firearm 10 may have features such as disclosed in U.S. patent application Ser. No. 11/672,189 filed Feb. 7, 2007, or U.S. patent application Ser. No. 11/869,676 filed Oct. 9, 2007, or U.S. patent application Ser. No. 11/339,187 filed Jan. 25, 2006, all of which are hereby incorporated by reference herein in their entirety. Firearm 10 may have operational features such as disclosed in U.S. Pat. Nos. 5,726,377, 5,760,328, 4,658,702, 4,433,610, U.S. Non Provisional patent application Ser. No. 10/836,443 filed Apr. 30, 2004, and U.S. Provisional Patent Application 60/564,895 filed Apr. 23, 2004, all of which are hereby incorporated by reference herein in their entirety. The firearm 10 and its sections described in greater detail below is merely exemplary. In alternate embodiments the firearm 10 may have other sections, portions or systems. As noted before, firearm 10 may have an upper receiver section 34 where upper receiver section 34 is shown as a 7.62 mm NATO upper receiver that may be of unitary construction with integral hand guard. In alternate embodiments, different (i.e. a one-piece member) caliber may be used and different removable hand guards may be used. Firearm 10 may have a barrel 36, direct, indirect or hybrid indirect gas operating system 38, and hand guard portion 40. In alternate embodiments, the firearm may have an indirect gas operating system or gas tube operating system. Further, in alternate embodiments, the firearm may have neither a piston nor gas operating system and may rely on recoil action to cycle the weapon, for example, in semi-automatic mode. Here, the gas operated linkage actuating the bolt carriage in the upper receiver may be replaced by a gas tube. Operating system 38 may have operational features such as disclosed in U.S. patent application Ser. No. 12/557,815 filed Sep. 11, 2009 or U.S. patent application Ser. No. 12/559,047 filed Sep. 14, 2009, all of which are hereby incorporated by reference herein in their entirety. Hand guard section 40 may have features such as disclosed in U.S. Pat. Nos. 4,663,875 and 4,536,982, or such as disclosed in U.S. patent application Ser. No. 12/341,970 filed Dec. 22, 2008 or U.S. patent application Ser. No. 12/100,268 filed Apr. 9, 2008, all of which are hereby incorporated by reference herein in their entirety. Hand guard section 40 of upper receiver section 34 may be configured to support such rails as a "Picatiny Rail" configuration as described in Military Standard 1913, which is hereby incorporated by reference herein in its entirety. The rails may be made from any suitable material such as hard coat anodized aluminum as an example. Rear sight assembly 50 is provided and mounted to upper receiver section 34. Firearm 10 may incorporate stock 42, lower receiver section 44, magazine well 46, clip or magazine 48 and rear and front sights 50, 52.

Figure 10A:
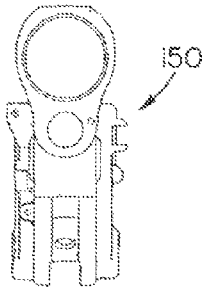
FIGS. 10A, 10B, 10C, 10D and 10E are respectively rear, top, side, bottom and front views of the lower receiver housing of the firearm shown in FIG. 1D.
Figure 10B:
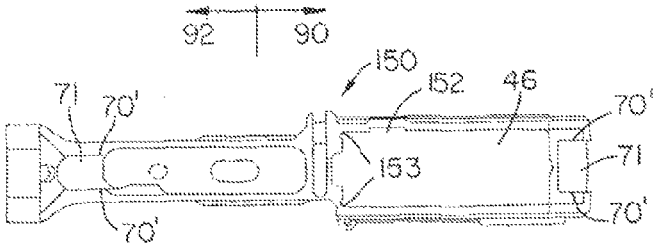
Figure 10C:
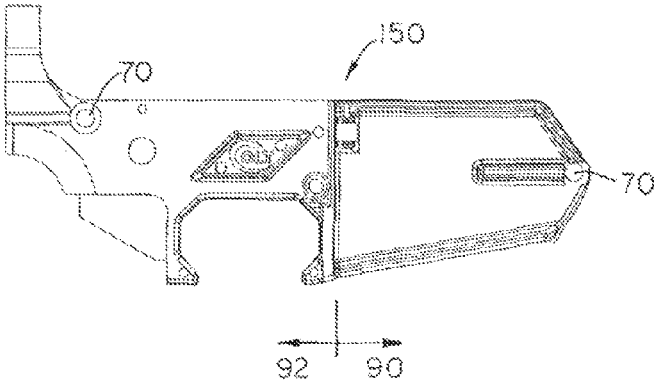
Figure 10D:
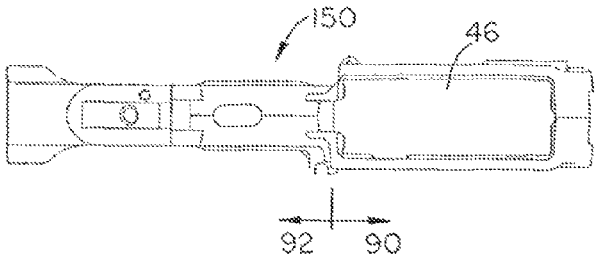
Figure 10E:
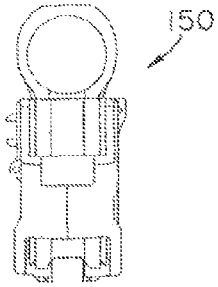
Figure 11B:
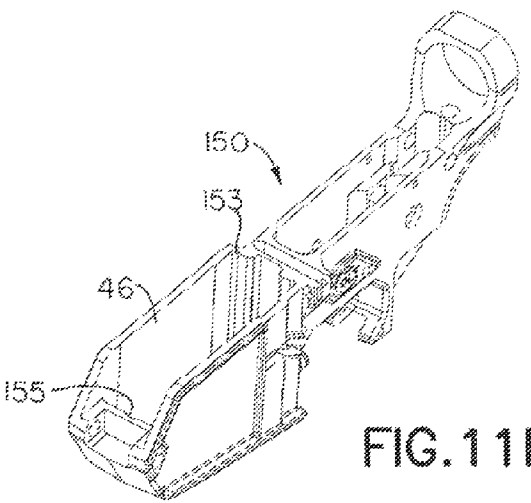
FIGS. 11A-11D are isometric views of the lower receiver housing of the firearm shown in FIG. 1D.
Figure 11D:
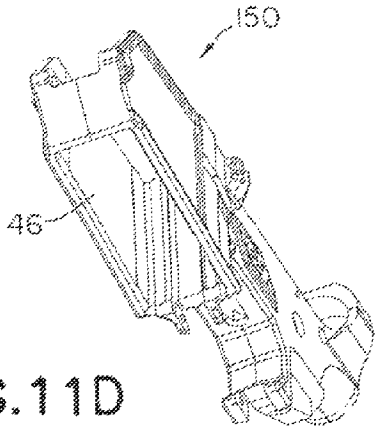
Figure 11A:
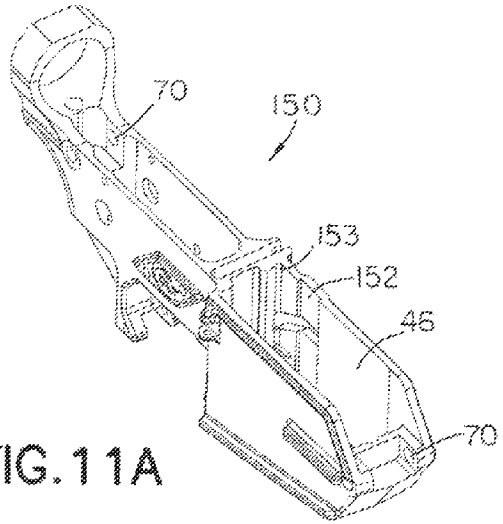
Figure 11C:
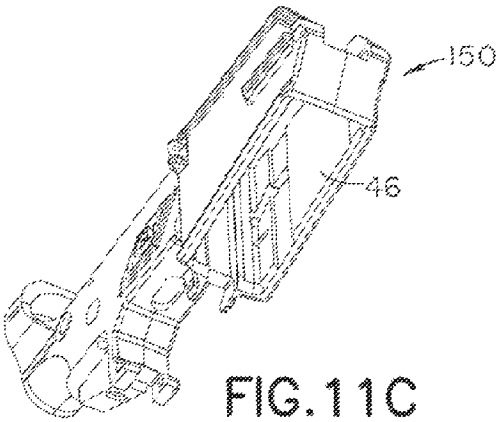

In the embodiment shown in FIGS. 2-3, lower receiver 44 is a common lower receiver (for example capable of mating with either a 7.62 mm NATO compatible upper receiver, and a 5.56 NATO type receiver and other upper receivers as previously described). For example, in the embodiment shown, a front portion 90 (see also FIG. 10B) of lower receiver 44 is NATO 7.62 mm compatible, for example having magazine well 46 that accepts NATO 7.62 mm magazine 48 (as well as magazines for smaller caliber rounds as will be further described), and a rear portion 92 of lower receiver 44, having a configuration that for purposes of description will be referred to as NATO 5.56 mm compatible (e.g. conforming to parameters and features consistent with NATO 5.56 mm Black Rifle lower receiver) as will be described in greater detail below. As such, front portion 90 has coupling pin hole 70 (see FIG. 2) located for coupling to a 7.62 mm NATO type upper receiver and with magazine well 46 sized to receive NATO 7.62 mm magazine 48. The arrangement of the coupling hole 70 is exemplary and in alternate embodiments any suitable configuration may be used. Lower receiver rear portion 92 being NATO 5.56 mm compatible has fire control assembly 93 having trigger, hammer, fire selector that may have features substantially similar to a NATO 5.56 mm lower receiver. In alternate embodiments, other suitable rear portions may be provided with features consistent with other calibers. In the exemplary embodiment and as will be described in greater detail below, firearm 10 is modular from a first configuration such as for the NATO 7.62 mm to another configuration, such as for the NATO 5.56 mm, by decoupling the upper receiver 34 from the lower receiver 44; mating an interface adapter (e.g. adapter 190, see FIG. 1C) to the lower receiver and coupling the lower receiver to a second upper receiver configured for firing a different round than the first upper. In accordance with one exemplary embodiment, the first main spring and the first buffer (configured for use with a first bolt carrier such as capable of interfacing to the 7.62 mm NATO round), may be replaced with a second main spring and second buffer (configured for use with a second bolt carrier capable of interfacing to the 5.56 mm NATO round) as will be described below, though in other exemplary embodiments, the lower receiver extension 114 (see FIG. 4), may house a common spring/buffer system as will also be described further below. Although, in the embodiment shown firearm 10 is modular or otherwise has a modular selectable configuration from for example, NATO 7.62 mm to NATO 5.56 mm; in alternate embodiments, any suitable combinations of bullet calibers may be provided or more calibers may be provided.

Stock 42 may have features such as disclosed in U.S. patent application Ser. No. 12/246,542 filed Oct. 6, 2008 or U.S. patent application Ser. No. 11/869,679 filed Oct. 9, 2007, all of which are hereby incorporated by reference herein in their entirety. Upper receiver 34 having barrel 36, lower receiver 44 and magazine well 46 may be modular and configurable such that firearm 10 comprises a modular rifle design. Further, the hand guard, and accessory mounting rails thereon, may be integral with the upper receiver and the integral upper receiver, hand guard and mounting rails may be of unitary construction. In alternate embodiments, the upper receiver and hand guard may be separate. Pins 68 couple upper receiver 34 to lower receiver 44 where lower receiver has holes 70 that accept bored lugs 72 of the upper receiver 34. Lugs 72 have outer surfaces 72' that mate with inner surfaces 70' of receiving portion 71 of lower receiver 44 that accepts lugs 72. In this manner, lugs 72 are captured and retained within receiving portion 71 of lower receiver 44. The coupling interface in the exemplary embodiments enables relative movement between upper and lower receiver assembly, such as by rotation about pin 68, to access the interior of the upper and lower receivers and allow removal or access to the bolt carrier assembly (not shown) without entirely decoupling or separating the upper and lower receiver assemblies, and without other disassembly of the upper and lower receiver assemblies than for example, disengagement of rear coupling pin 68. Although lower receiver 44 is coupled to upper receiver 34 using lugs and lug receiving portions with pins, in alternate embodiments, any suitable fastening and/or locating method may be used, for example, the lugs may be on the lower receiver and the receiving portions on the upper receiver on one or both coupling locations. By way of further example, any suitable locating feature combined with a fastening feature or fastener may be provided that may or may not require tools for assembly and disassembly and that may or may not require removal of a pin or fastener, such as where the upper receiver is mated with the lower receiver by a latching method. By way of further example, the fastening and locating feature at the forward portion of the lower receiver to the upper receiver may be different than the fastening and locating feature at the rear portion of the lower receiver to the upper receiver. In alternate embodiments, a single fastening and locating feature or more fastening and locating features may be provided to couple the lower receiver to the upper receiver. In alternate embodiments, separate locating feature(s) and fastening feature(s) may be provided. Further and similarly with respect to adapter(s) used to couple lower receiver 44 to different upper receiver(s) that may have different caliber(s) or features, any suitable method of fastening and locating features may be provided. Bolt catch release lever 80 is provided to return the bolt to the battery position upon firing the last round in magazine 48. Magazine release button 82 and magazine release lever 84 are provided to release magazine 48 from lower receiver 44. As will be described below, magazine release lever 84 retains magazine 48 upon complete insertion into well 46.

Figure 4:
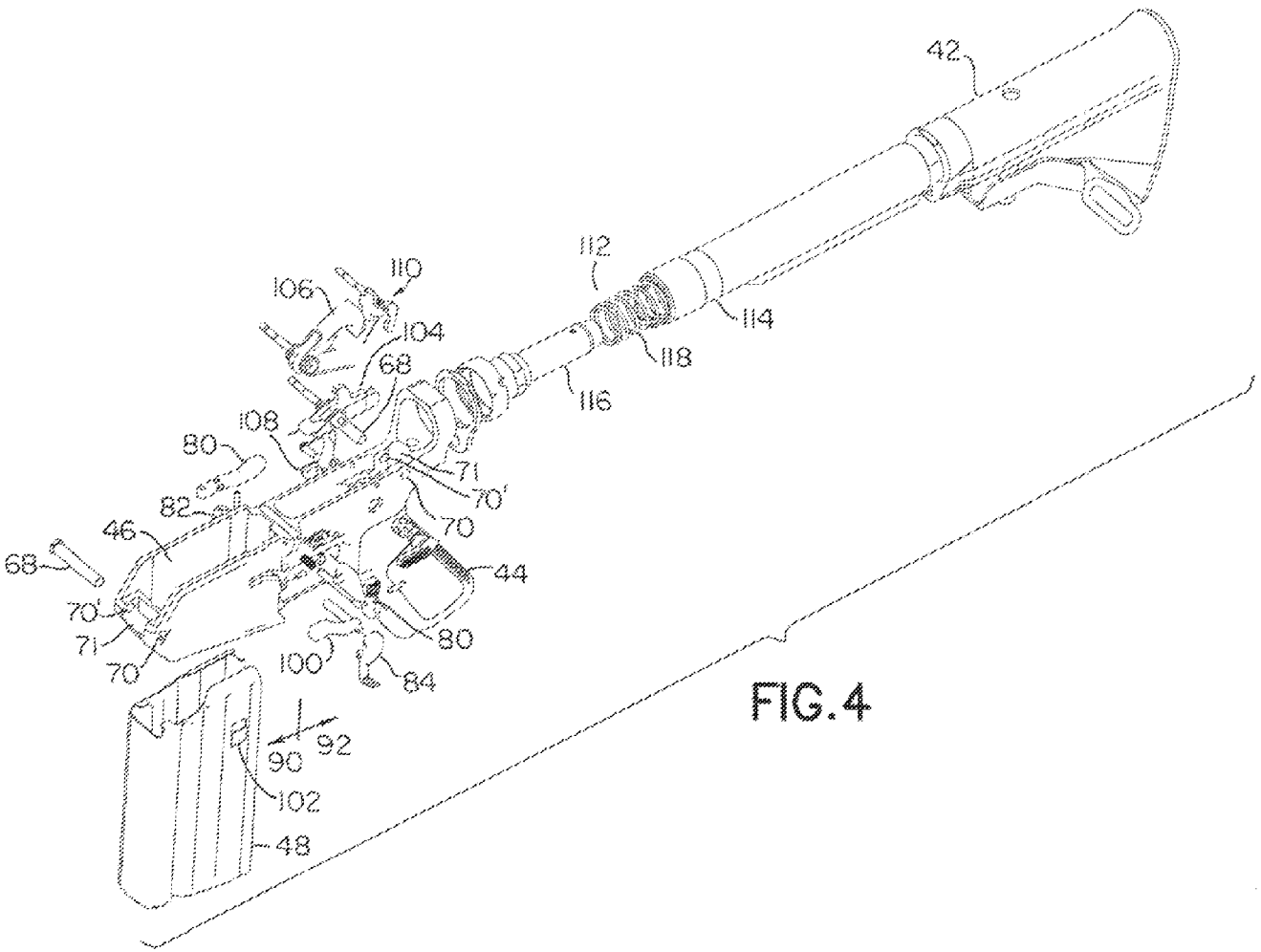
FIG. 4 is an exploded isometric view of the lower receiver of the firearm shown in FIG. 1D.
Figure 5:
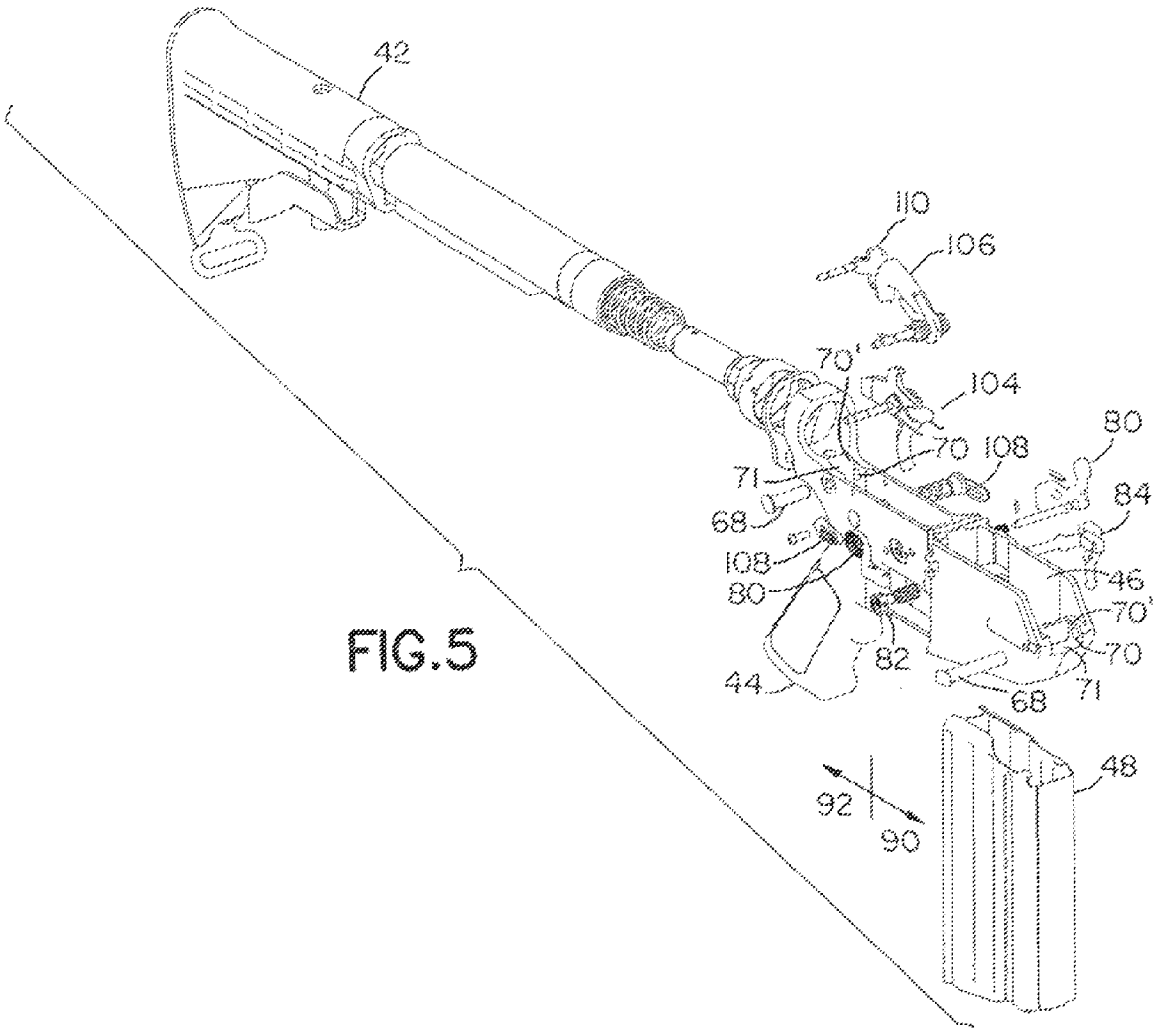
FIG. 5 is another exploded isometric view of the lower receiver of the firearm shown in FIG. 1D.
Figure 20B:
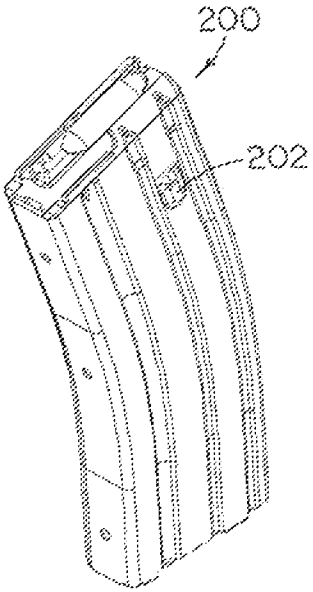
FIGS. 20A and 20B are isometric views of the 5.56 mm magazine.
Figure 20A:
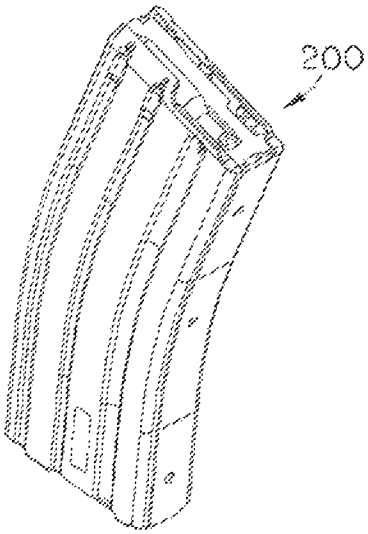

Referring now to FIG. 4, there is shown an exploded isometric view of the common lower receiver 44 of the firearm 10 shown in FIG. 10. As noted before the lower receiver 44 in the exemplary embodiment is capable of interfacing with different interchangeable upper receivers, each capable of firing different NATO chamber rounds. Hence, the lower receiver 44 may be referred to as a common lower receiver for the different interchangeable upper receivers. Referring also to FIG. 5, there is shown an exploded isometric view of the lower receiver of the firearm shown in FIG. 1D. In the exemplary embodiment, lower receiver section 44, may be an assembly including receiver extensions and stock 42, magazine well 46 and clip or magazine 48. In the embodiment shown, lower receiver 44 is shown having front portion 90 having magazine well 46 configured so that it is capable of accepting magazines for different rounds such that NATO 7.62 mm magazine 48 and the NATO 5.56 mm magazine (see also FIGS. 19, 20). The portion 92 of the lower receiver, to the rear of front portion includes the trigger and fire control group and the receiver extension. Magazine well 46 may have interlock features, for example rails or detents that may be both exterior and interior to couple with mating features on the magazine 48 or the interface adapter as will be described below to fix the adapter to the lower receiver. Front portion 90 of lower receiver 44 has coupling pin hole 70 located for coupling to an upper receiver 34 (e.g. a 7.62 mm NATO compatible upper receiver) and with magazine well 46 sized to receive conventional for example NATO 7.62 mm magazine 48. Pins 68 are shown that couple upper receiver 34 to lower receiver 44 where lower receiver has holes 70 that accept bored lugs 72 of the upper receiver 34. Bolt catch release lever 80 is provided to return the bolt to the battery position upon firing the last round in magazine 48. Magazine release button 82 and magazine release lever 84 are provided to release magazine 48 from lower receiver 44. Magazine release lever 84 retains magazine 48 where projection 100 of release 84 engages tab 102 of magazine 48 upon complete insertion into well 46. Pressing release button 82 disengages projection 100 from tab 102 allowing the magazine 48 to be ejected. As noted before, rear portion 92 of lower receiver has features consistent for example with a 5.56 mm NATO lower receiver 44 including trigger 104, hammer 106, fire control selector 108, and auto sear 110. Lower receiver may have a separable or integral grip and features for mounting stock. As may be realized, in alternate embodiments the upper receiver may be coupled conventionally to the lower receiver. The firearm 10 also has an action spring and buffer assembly 112 for motivating the return stroke of the bolt carrier during its cycle. The action spring and buffer assembly 112 of firearm 10 are housed within the lower receiver rear extension 114. In the exemplary embodiment shown, the receiver extension may be positioned and configured consistent with interface to a 5.56 mm NATO compatible upper receiver and bolt carrier assembly, though in the exemplary embodiment the receiver extension 114 and the entire lower receiver is further capable of interfacing with an upper receiver and bolt carrier compatible for example with the 7.62 mm NATO round. In the exemplary embodiment buffer 116 and action spring 118 may have different length, mass and stiffness such as for example, 7.62 mm compatibility as opposed to a 5.56 mm spring and buffer as will be described below. As described, in the embodiment shown, lower receiver 44 is shown as a 7.62×51 mm and 5.56 mm common lower receiver where a front portion 90 of lower receiver 44 is NATO 7.62 mm compatible having magazine well 46 that accepts NATO 7.62 mm magazine 48 and where a rear portion 92 of lower receiver 44 is NATO 5.56 mm compatible.

Figure 6A:
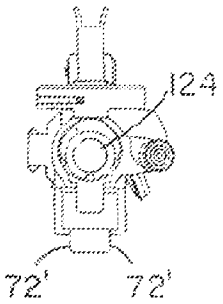
FIGS. 6A and 6B are respectively rear and right side views of a first upper receiver of the firearm capable of firing a round of a first caliber shown in FIG. 1D.
Figure 6B:
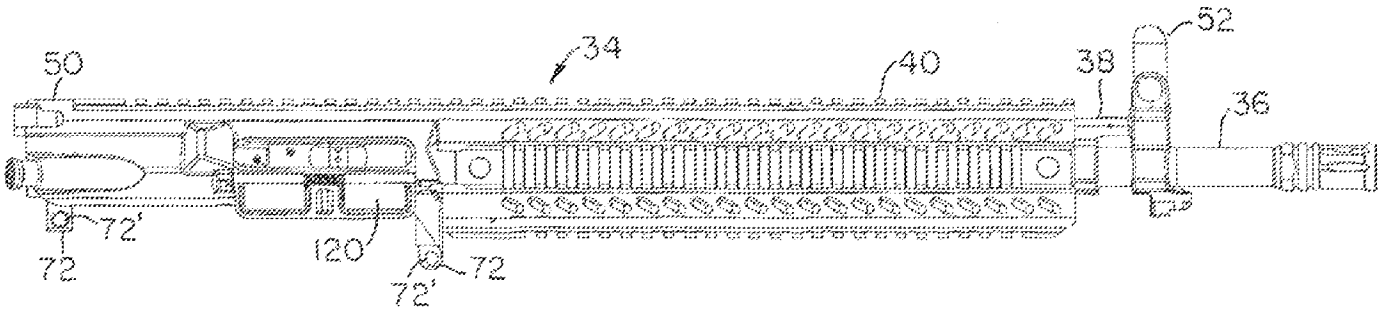
Figure 7:
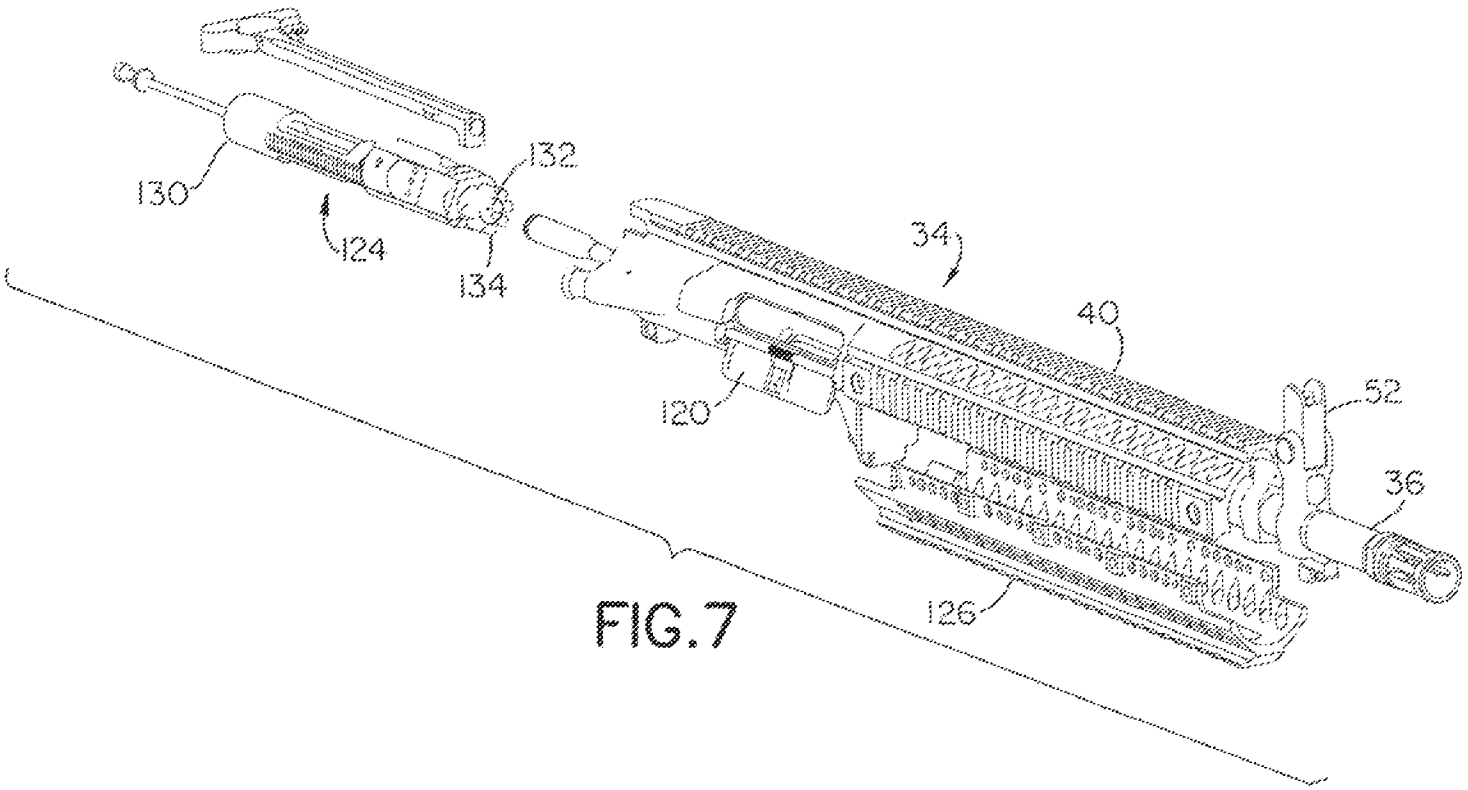
FIG. 7 is an exploded isometric view of the first upper receiver of the firearm shown in FIG. 1D.
Figure 8:
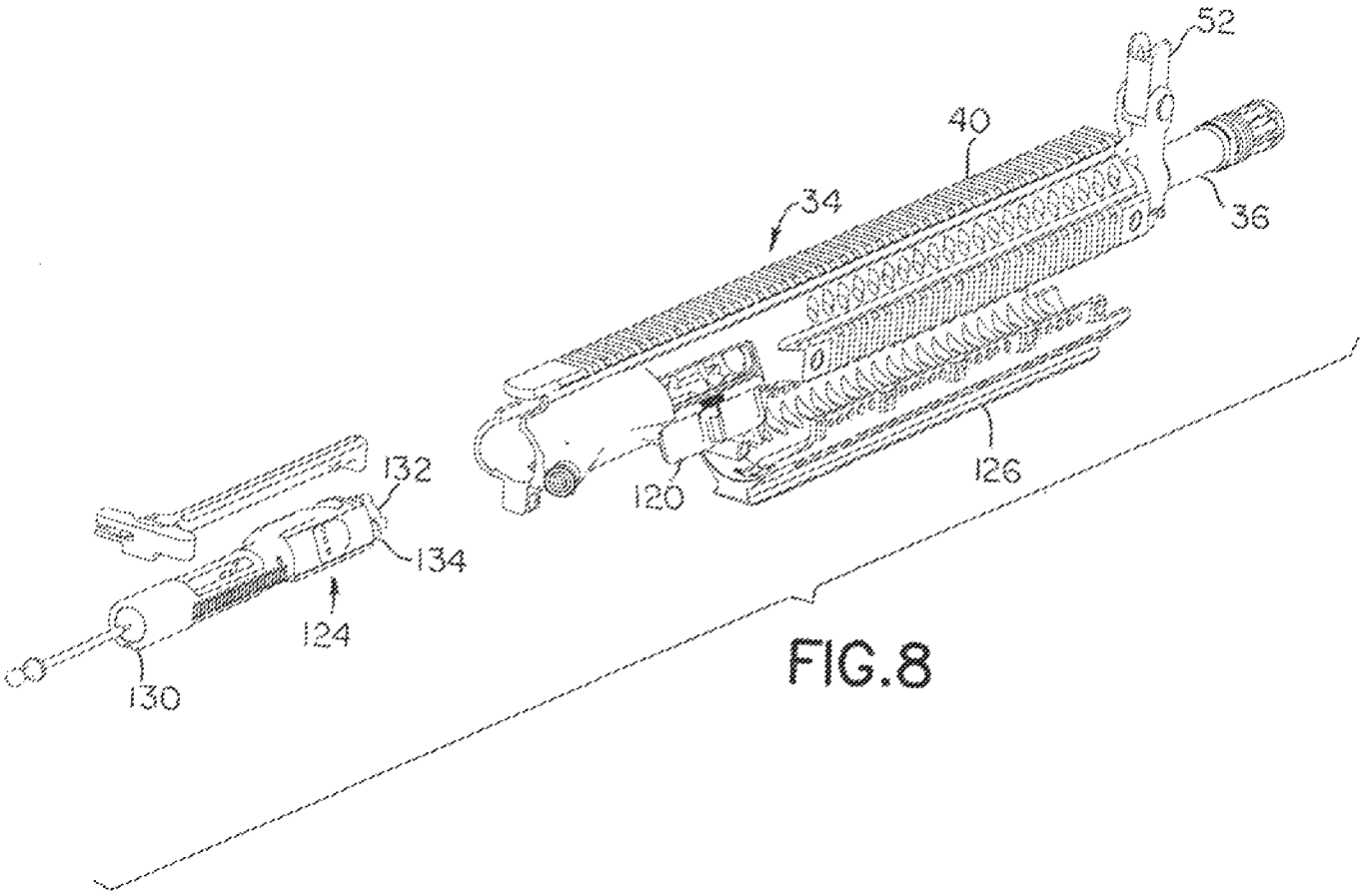
FIG. 8 is an exploded isometric view of the first upper receiver of the firearm shown in FIG. 1D.

Referring now to FIGS. 6A and 6B, there are respectively shown rear and right side views of the upper receiver 34 of the firearm shown in FIG. 1D configured for example for compatibility with the 7.62 mm NATO round. Referring also to FIGS. 7 and 8, there are exploded isometric views of the upper receiver 34 of the firearm 10 shown in FIG. 1D. Upper receiver section generally has barrel 36 direct or indirect gas operating system 38, hand guard 40, rear and front sights 50, 52, ejection port cover 120 attachment and bolt carrier assembly 124. The barrel and/or the bolt/bolt carrier may be coupled to upper receiver section using conventional splined and/or threaded/pinned locking techniques or otherwise. Hand guard 40 may have features such as disclosed in U.S. Pat. Nos. 4,663,875 and 4,536,982, both of which are hereby incorporated by reference herein in their entirety. Hand guard may have features for mounting additional devices on one or more rails (e.g. "Piccatiny Rail" or other suitable configuration) for attachment of any suitable peripheral devices. In the embodiment shown, rifle 10 has receiver having an integral hand guard portion with barrel removably connected to receiver. In alternate embodiments the handguard portion may be removable from the upper receiver. Hand guard 40 is shown having a removable bottom portion with integral lower rail for different mounting options that may be provided. In this embodiment the rail may be located at the six (6) o'clock position relative to the barrel axis, though in alternate embodiments the removable rail may be located in any other desired location. The bottom portion may be removable to install other accessories with a differently configured bottom portion, such a grenade launcher as an example. The removable bottom portion having an integral rail may have features or be mounted using a keyed/key way system or tongue and groove system or other suitable system, such as described in U.S. Patent Application No. 60/772,494, filed Feb. 9, 2006 and U.S. patent application Ser. No. 12/100,268, filed Apr. 9, 2008, all of which hereby incorporated by reference in their entirety. Here, the upper receiver 34 is shown as unitary with integral hand guard 40, and has a bolt carrier assembly 124 and bolt therein, that in the exemplary embodiment may be configured for operation with the 7.62 mm NATO round. In contrast to a conventional bolt carrier assembly, bolt carrier assembly 124 is configured to interface and operate with the lower receiver (e.g. configured as previously described consistent for interface with the 5.56 mm NATO bolt carrier assembly) as will be described below.

Figure 9B:
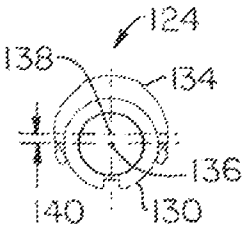
FIGS. 9A and 9B are respectively side and rear views of the first bolt carrier used with the first upper receiver of the firearm shown in FIG. 1D.
Figure 9A:
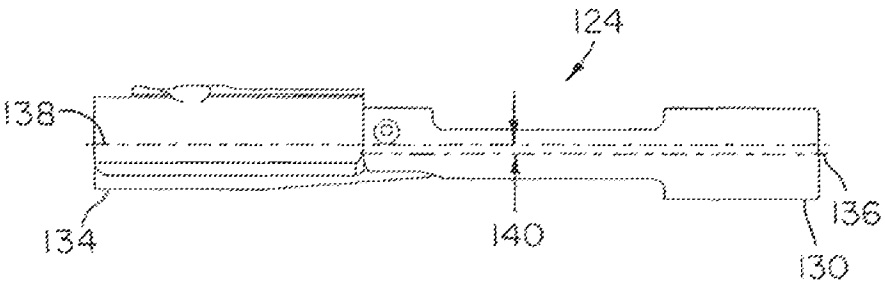

Referring now also to FIGS. 9A and 9B, there are respectively shown side and rear views of the bolt carrier 124 for the upper receiver 34 of the firearm shown in FIG. 1D. In the exemplary embodiment the bolt carrier rear 130 is shown configured for interface with the 5.56 mm receiver extension tube 114 coupled to lower receiver 44 and buffer 116 and having a similar diameter with respect to a 5.56 mm compatible buffer. As may be realized, the exterior of the rear portion of the bolt carrier frame is sized and shaped to conform to the receiver extension tube 114. In the exemplary embodiment, a smaller diameter bolt carrier rear and shorter length (relative to a conventional 7.62 mm NATO bolt carrier) provide compatibility with the rear portion 92 of lower receiver 44. Additionally, the center line 136 and reaction axis of rear portion 130 of bolt carrier is offset from 7.62 mm bolt 134 and the center line of front portion 134 of bolt carrier 124 where the rear portion 130 of bolt carrier 124 is eccentric with respect to bolt 132 and front portion 134 of bolt carrier 124. Here, the rear bolt center line 136 is lower (towards the lower receiver) relative to a reference datum bolt centerline as compared to a conventional 7.62 mm bolt/bolt carrier. As may be realized from FIGS. 9A-9B, the guide surfaces on the bolt carrier guiding the reciprocating action of the bolt carrier are offset relative to each other between the front 134 and rear portion 130 of the carrier 124. In the exemplary embodiment, the bolt centerline 138 may be offset towards the lower receiver a desired amount compared to a conventional 7.62 mm NATO upper receiver. As may be realized, features of the upper receiver 38 located from the bolt centerline 138 may be located commensurate with the offset.

Referring now to FIGS. 10A, 10B, 10C, 10D and 10E, there are respectively shown rear, top, side, bottom and front views of the lower receiver housing of the firearm shown in FIG. 1D. Referring also to FIGS. 11A-11D, there are shown isometric views of the lower receiver housing of the firearm shown in FIG. 1D. Lower receiver section 44 has housing 150 with magazine well 46. Well 46 has slot 152 that is shown allowing tab 102 (see FIG. 4) of magazine 48 to not interfere when magazine 48 is inserted into well 46. In the exemplary embodiment, the lower receiver housing 150 is shown as having what may be referred to as a hybrid configuration, such as a 7.62×51 mm portion and a 5.56 mm portion in a portion in a lower receiver common housing. As noted before, a front portion 90 of lower receiver 44 is NATO 7.62 mm compatible having magazine well 46 that accepts up to a NATO 7.62 mm magazine 48 and other caliber magazines down to 5.56 mm NATO magazine 200 (see FIGS. 19-20) and a rear portion 92 of lower receiver 44 is NATO 5.56 mm compatible as described previously. In the exemplary embodiment shown, the magazine may be of one piece unitary construction with the magazine well portion integral to the lower receiver housing. In alternate embodiments, the magazine well portion may be, removably mounted or joined to the lower receiver, such as a modular attachment fastened without separate detachable fasteners, for example as shown and described in U.S. Pat. No. 7,131,228, issued Nov. 7, 2006, and incorporated by references herein in its entirety. Magazine well 46 may have interlock features, for example rails 153 or detents 155 that may be both exterior and interior to couple with mating features on the magazine 48 or the interface adapter 190 (see also FIGS. 17) as will be described below to fix the adapter to the lower receiver. Front portion 90 of lower receiver 44 has coupling pin hole 70 located for coupling to a 7.62 mm lower receiver and with magazine well 46 sized to receive conventional NATO 7.62 mm magazine 48. Pins couple upper receiver 34 to lower receiver 44 where lower receiver has holes 70 that accept bored lugs 72 of the upper receiver 34.

Figure 12A:
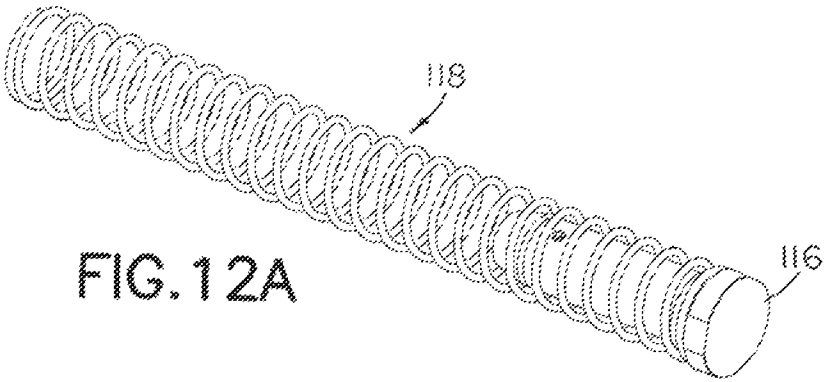
FIG. 12A is an isometric view of a first main action spring used with the first bolt carrier.

Referring now to FIG. 12A, there is shown an isometric view of a first action spring 118 sized and shaped to be housed in the rear receiver extension 114 of the lower receiver. The action spring 118 is further sized and shaped to provide the desired dynamic interface for 7.62 mm bolt carrier and may be referred to for convenience as the 7.62 mm spring. The 7.62 mm spring 118 and buffer 116 are compatible with the 5.56 mm portion of lower receiver 44 and rear extension tube 114. Here, buffer 116 and action spring 118 have a different length, mass and stiffness for 7.62 mm as compared to the 5.56 mm spring and buffer shown in FIG. 12B.

Figure 12B:
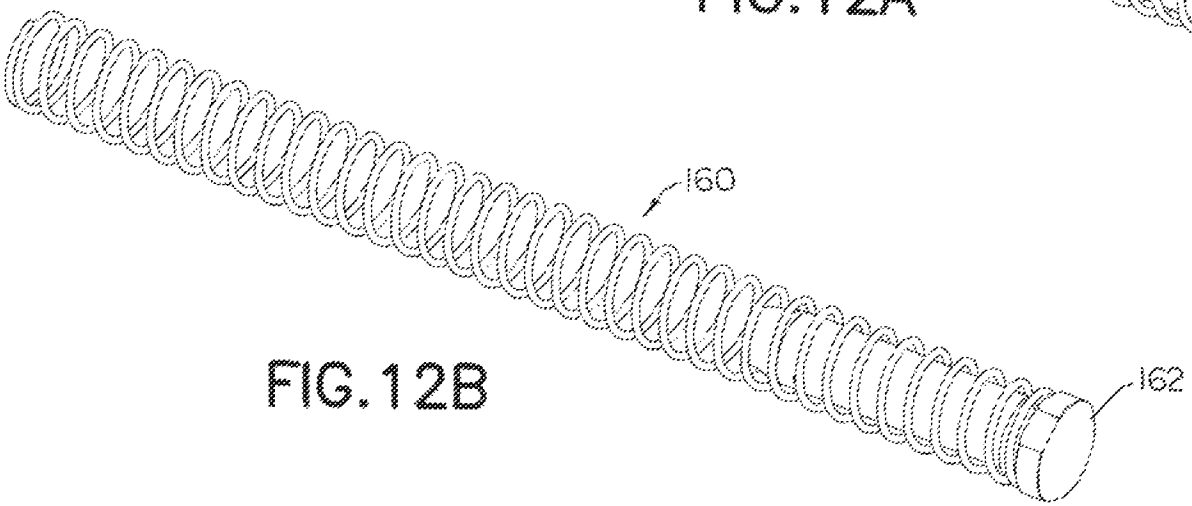
FIG. 12B is an isometric view of a second main action spring.
Figure 13E:
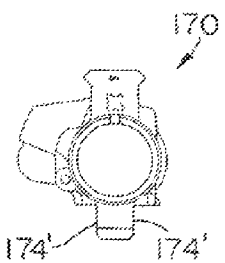
FIGS. 13A, 13B, 13C, 13D and 13E are respectively rear, top, side, bottom and front views of a second upper receiver housing configured for firing a round of a second caliber.
Figure 13B:
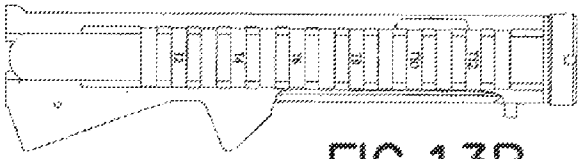
Figure 13C:
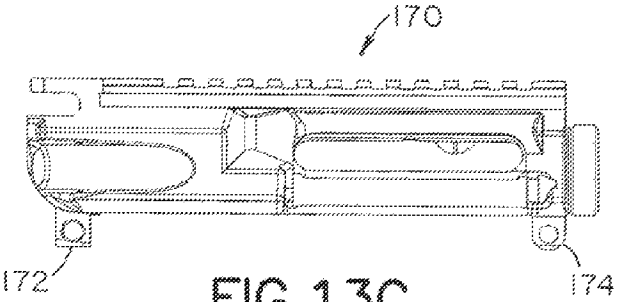
Figure 13D:
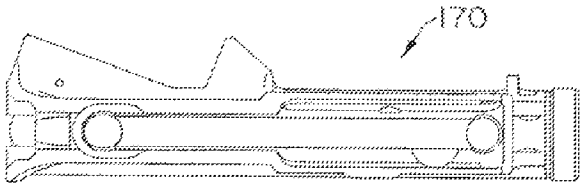
Figure 13A:
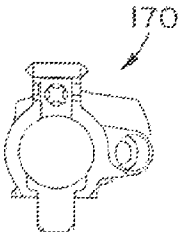
Figure 14B:
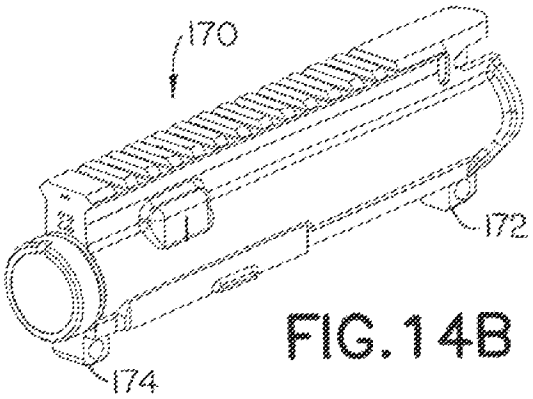
FIGS. 14A-14D are isometric views of the second upper receiver housing.
Figure 14D:
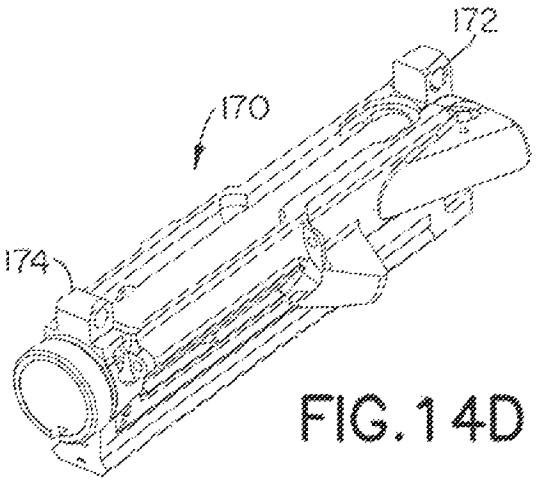
Figure 14A:
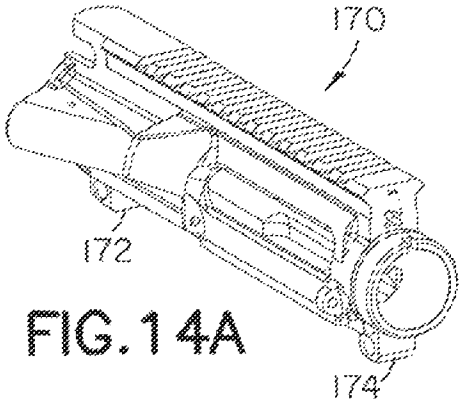
Figure 14C:
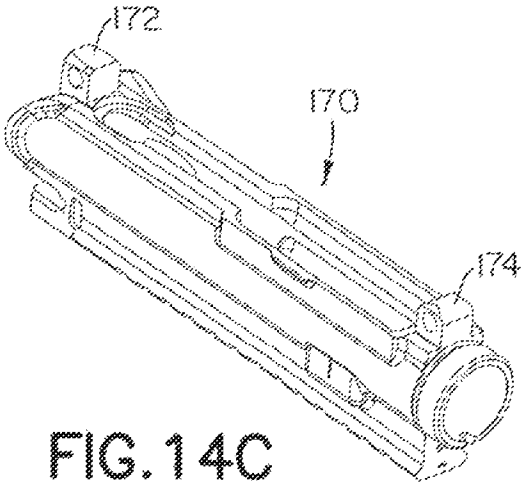
Figure 15E:
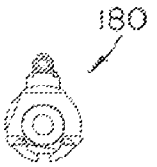
FIGS. 15A, 15B, 15C, 15D and 15E are respectively rear, top, side, bottom and front views of a second bolt carrier.
Figure 15B:
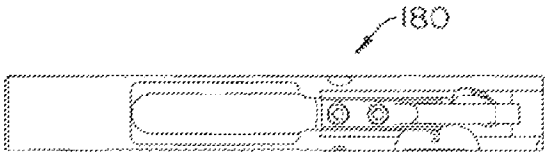
Figure 15C:
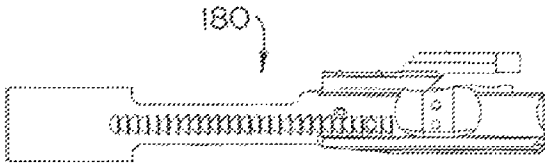
Figure 15D:
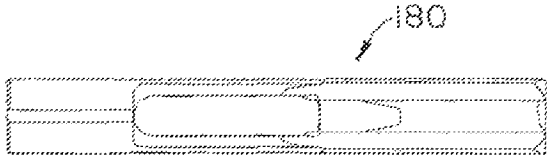
Figure 15A:
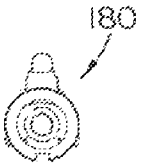
Figure 16B:
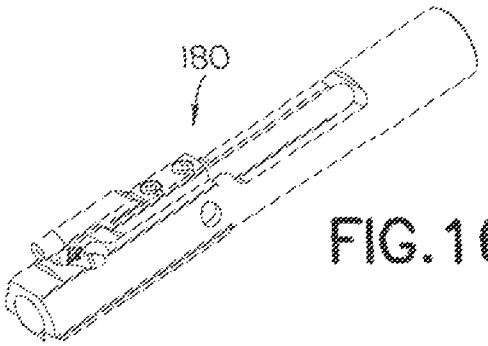
FIGS. 16A-16D are isometric views of the second bolt carrier.
Figure 16D:
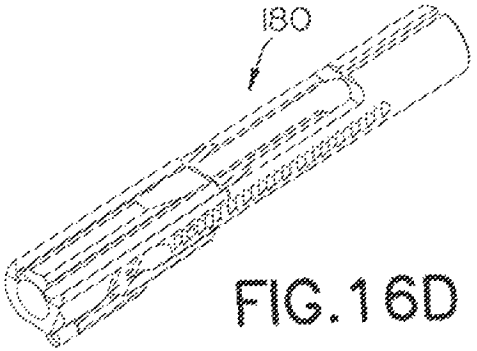
Figure 16A:
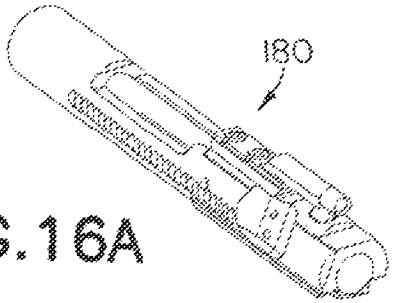
Figure 16C:
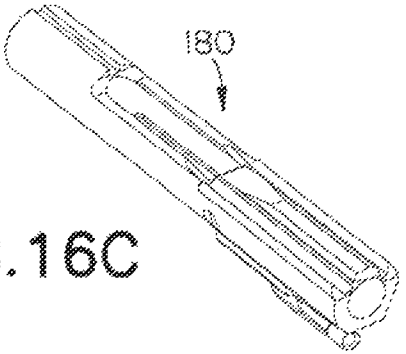
Figure 17F:
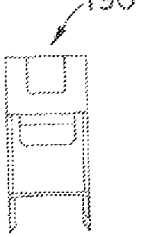
FIGS. 17A, 17B, 17C, 17D, 17E and 17F are respectively left side, rear, top, right side, bottom and front views of an interface adapter.
Figure 17C:
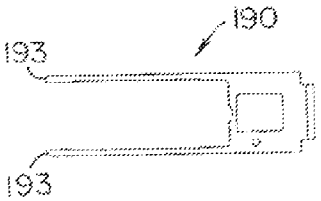
Figure 17D:
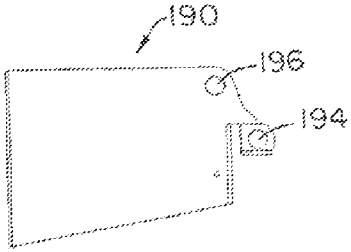
Figure 17E:
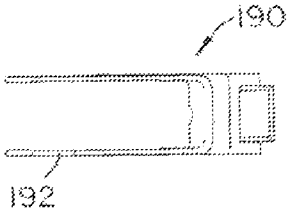
Figure 17B:
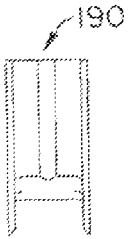
Figure 17A:
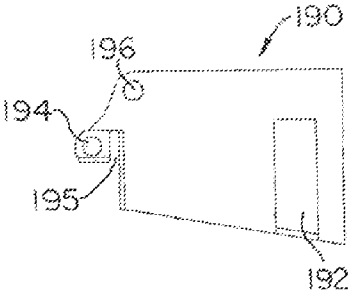
Figure 19B:
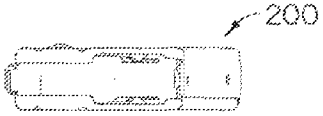
FIGS. 19A, 19B, 19C, 19D, 19E and 19F are respectively rear, top, right side, bottom, front, and left side views of a 5.56 mm magazine.
Figure 19C:
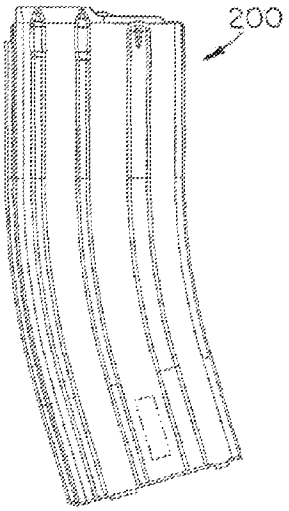
Figure 19D:
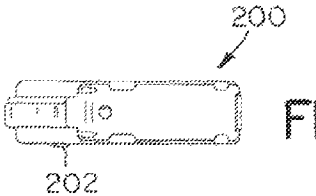
Figure 19E:
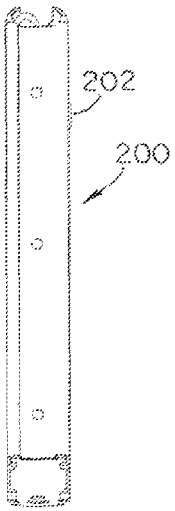
Figure 19F:
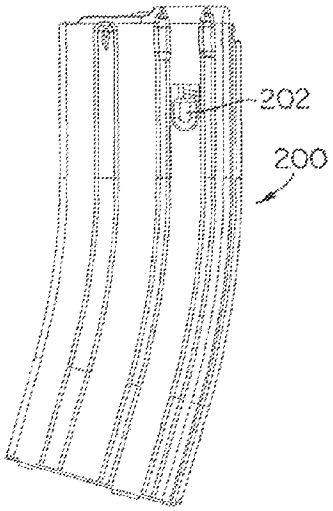
Figure 19A:
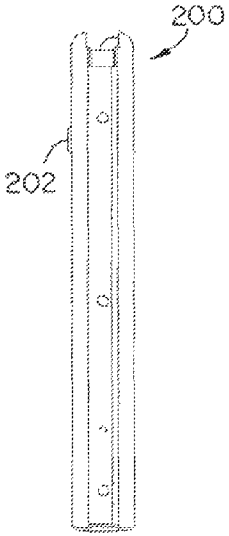

Referring now to FIG. 12B, there is shown an isometric view of a 5.56 mm spring 160. The 5.56 mm spring 160 and buffer 162 are conventional and compatible with the 5.56 mm portion of lower receiver 44 and rear extension tube 114. Here, buffer 116 and action spring 118 have a different length, mass and stiffness for conventional 5.56 mm as compared to the 7.62 mm spring and buffer shown in FIG. 12A.

Referring now to FIGS. 13A, 13B, 13C, 13D and 13E, there are respectively shown rear, top, side, bottom and front views of an upper receiver housing 170, for example for upper receivers 20, 252 (see also FIG. 1B) such as may be compatible with NATO 5.56 mm rounds. Referring also to FIGS. 14A-14D, there are shown isometric views of the upper receiver housing 170. In the exemplary embodiment shown, the upper receiver 170 may have a separate handguard, though in alternate embodiments the upper receiver may be of unitary construction, including an integral handguard similar to upper receiver 34 (shown in FIGS. 4-8). Upper receiver housing 170 is shown as features substantially similar to a conventional, 5.56 mm upper receiver housing for a black rifle type firearm. Lug 172 has a bore that interfaces with the rear hole 70 in lower receiver 44 and engages pin 68 to couple the rear portion of housing 170 to lower receiver 44. In the exemplary embodiment shown, the lugs 172, 174 are positioned (for example relative to the barrel mount center line and barrel chamber reference datum (not shown)) consistent with the configuration of a NATO 5.56 mm upper receiver. As will be described below, lug 174 of upper receiver housing 170 has a bore that interfaces with a hole in the 7.62 mm to 5.56 mm magazine adapter and engages pin 68 to couple the front portion of housing 170 to the adapter. The adapter further has a lug having a bore that engages a third pin 68 with the front bore 70 of lower receiver 44. As such the front portion of 5.56 mm upper receiver housing 170 is coupled to the common lower receiver 44. The upper receiver housing may interface with a separate hand guard that may be a split guard having upper and lower sections that may be removable. In alternate embodiments, the guard may include fewer or more sections (e.g. the hand guard may have, three four or more guard sections extending along the barrel generally similar to the upper and lower hand guards). An upper hand guard may be provided unitary with integral upper rail of receiver the upper rail of the hand guard may be aligned with the rail integrally formed on the upper receiver and extends in front of upper rail when upper hand guard is mounted. A suitable hand guard is disclosed U.S. patent application Ser. No. 12/100,268, filed Apr. 9, 2008, which is hereby incorporated by reference in its entirety.

Referring now to FIGS. 15A, 15B, 15C, 15D and 15E, there are respectively shown rear, top, side, bottom and front views of a conventional 5.56 mm bolt carrier 180. Referring also to FIGS. 16A-16D, there are shown isometric views of the 5.56 mm bolt carrier 180.

Referring now to FIGS. 17A, 17B, 17C, 17D, 17E and 17F, there are respectively shown left side, rear, top, right side, bottom and front views of an interface adapter 190. Referring also to FIGS. 18A-18D, there are shown isometric views of the interface adapter 190. As may be realized, in the exemplary embodiment, the interface adapter may not be installed for interface of the lower receiver with upper receiver 34 (e.g. 7.62 mm NATO) and may be installed for interface of the lower receiver with upper receiver 170 (e.g. 5.56 mm NATO) such that the lower receiver may receive both 7.62 mm NATO and 5.56 mm NATO magazines. In the exemplary embodiment, the interface adapter is removed from the lower receiver for coupling to the upper receiver 34, and is mated to the lower receiver for coupling to the upper receiver 170. Adapter 190 may be removably mounted into magazine well 46 and can be made of any suitable material such as metal, plastic, ceramic or otherwise. In the exemplary embodiment, adapter 190 couples to the 7.62 mm coupling pin 68 of lower receiver 44 via first coupling pin hole 194 and forming a lug with mating surfaces 194' that mate with surfaces 70' of receiving portion 71 (see also FIGS. 2 and 11A-11D). Hole 194 is positionally located to mate to lower receiver 44 front coupling pin 68 and hole 70 in the forward portion of lower receiver 44. In addition, adapter 190 may be positionally fixed by detention features 193, 195 engagement with complementing feature 153, 155 (see FIGS. 11A-11B) of lower receiver 44. Adapter 44 has a second coupling pin hole 196 and forms a receiving portion 197 with mating surfaces 197' that receives forward lug 174 of upper receiver 170 where mating surfaces 197' mate with surfaces 174' of lug 174 and that enables coupling of lower receiver 44 to 5.56 mm upper receiver housing 170. Here, lug 174 of upper receiver housing 170 has a bore that interfaces with hole 196 in the 7.62 mm to 5.56 mm magazine adapter 190 and engages pin 68 to couple the front portion of housing 170 to the adapter 190 where the pin in combination with the opposing mating surfaces couples adapter 190 to upper receiver 170. As covered previously, adapter 190 further has a lug 194 having a bore that engages a third pin 68 with the front bore 70 of lower receiver 44. As described the front portion of 5.56 mm upper receiver housing 170 may be coupled to the lower receiver 44. The outer envelope of adapter 190 is such that well 46 accepts adapter 190 similar to the magazine 48 but inserted through the top of lower receiver 44. Slot 192 allows a tab of a 5.56 mm magazine to pass without interference. The interior portion of adapter 190 is configured to accept a 5.56 mm magazine positionally in well 46 such that 5.56 mm cartridges may be supplied to a 5.56 mm compatible upper receiver mounted on lower receiver 44.

Referring now to FIGS. 19A, 19B, 19C, 19D, 19E and 19F, there are shown respectively rear, top, right side, bottom, front, and left side views of a 5.56 mm magazine. Referring also to FIGS. 18A and 18B, there are shown isometric views of the 5.56 mm magazine. 5.56 mm magazine 200 is shown having tab 202. Similar to the retention and release of magazine 48, magazine release lever 84 retains magazine 200 where projection 100 of release 84 engages tab 202 of magazine 200 upon complete insertion into well 46. Pressing release button 82 disengages projection 100 from tab 202 allowing the magazine 48 or 200 to be ejected. Further, slot 192 of adapter 190 allows tab 202 of 5.56 mm magazine 200 to pass without interference during insertion and removal from well 46 when adapter 190 is installed.

Figure 21A:
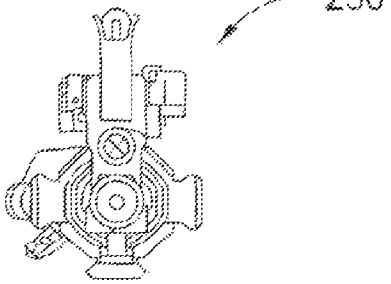
FIG. 21A is an end view of a 5.56 mm upper receiver.
Figure 21B:
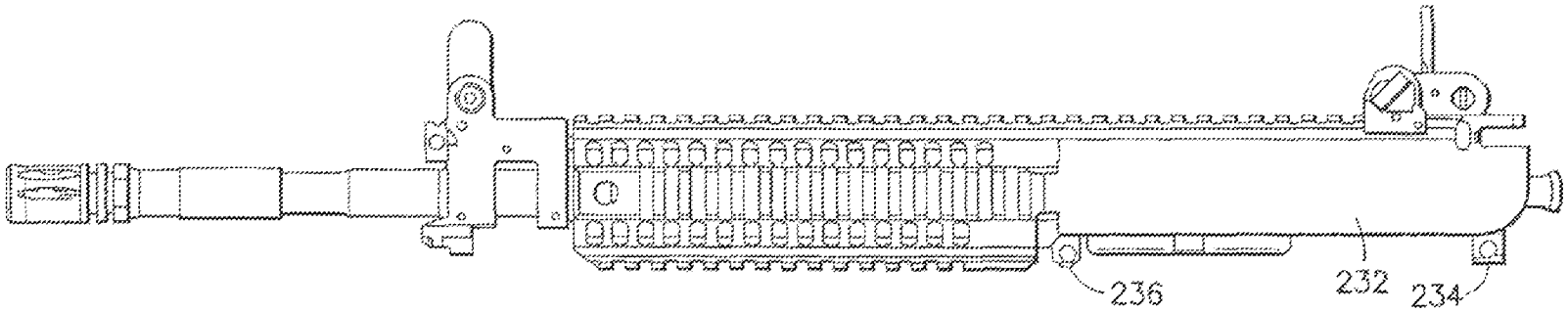
FIG. 21B is a side view of a 5.56 mm upper receiver.

Referring now to FIG. 21A, there is shown an end view of a 5.56 mm upper receiver 230. Referring also to FIG. 21B, there is shown a side view of a 5.56 mm upper receiver 230. In the exemplary embodiment shown, the upper receiver 230 has frame 232 where the upper receiver is shown of one piece unitary construction, including an integral hand guard. Upper receiver housing 230 is shown as features substantially similar to 5.56 mm upper receiver housing for a black rifle type firearm such as the upper receiver shown and described in U.S. patent application Ser. No. 11/352,036, previously incorporated by reference herein, or other 5.56 mm compatible upper receiver. Lug 234 has a bore that interfaces with the rear hole 70 in lower receiver 44 and engages pin 68 to couple the rear portion of housing 230 to lower receiver 44. Lug 236 of upper receiver housing 230 has a bore that interfaces with hole 196 in the 7.62 mm to 5.56 mm magazine adapter 190 and engages pin 68 to couple the front portion of housing 230 to the adapter 190. Adapter 190 further has lug 194 having a bore that engages a third pin 68 with the front bore 70 of lower receiver 44. As such the front portion of 5.56 mm upper receiver housing 230 is coupled to the lower receiver 44.

Figure 22A:
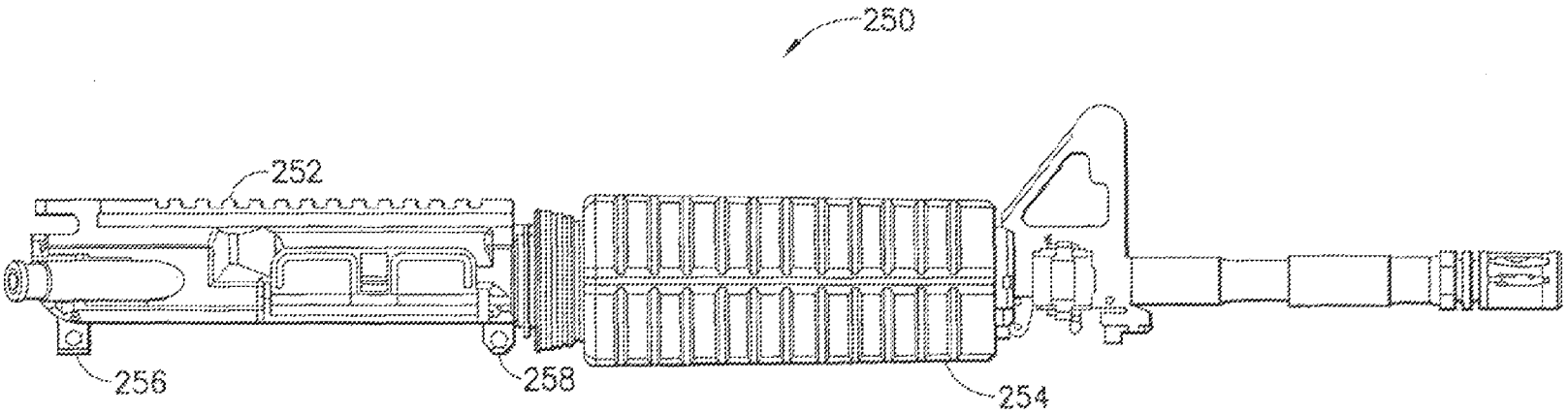
FIG. 22A is a side view of a 5.56 mm upper receiver.
Figure 22B:
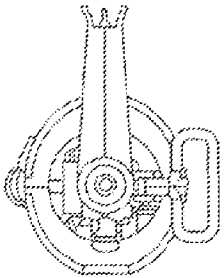
FIG. 22B is an end view of a 5.56 mm upper receiver.

Referring now to FIG. 22A, there is shown an end view of a 5.56 mm upper receiver 250. Referring also to FIG. 22B, there is shown a side view of a 5.56 mm upper receiver 250. In the exemplary embodiment shown, the upper receiver 250 has frame 252 where the upper receiver is shown including a separable hand guard 254. Upper receiver housing 250 is shown as features substantially similar to a 5.56 mm compatible upper receiver housing for a black rifle type firearm. Lug 256 has a bore that interfaces with the rear hole 70 in lower receiver 44 and engages pin 68 to couple the rear portion of housing 250 to lower receiver 44. Lug 258 of upper receiver housing 250 has a bore that interfaces with hole 196 in the 7.62 mm to 5.56 mm magazine adapter 190 and engages pin 68 to couple the front portion of housing 250 to the adapter 190. Adapter 190 further has lug 194 having a bore that engages a third pin 68 with the front bore 70 of lower receiver 44. As such the front portion of 5.56 mm upper receiver housing 250 is coupled to the lower receiver 44.

Figure 23:
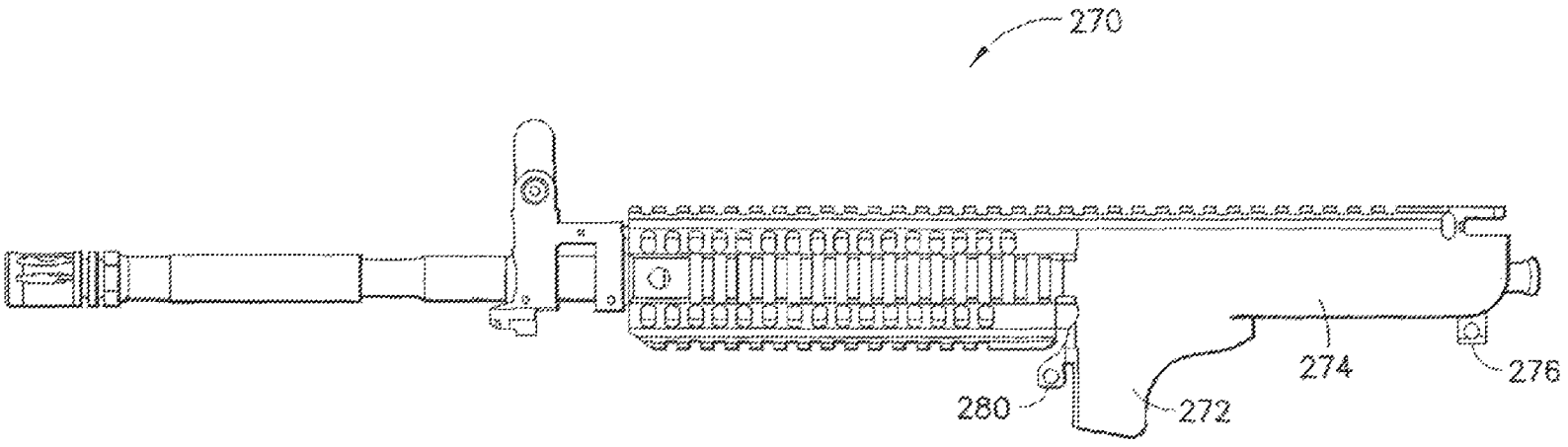
FIG. 23 is a side view of a dedicated 5.56 mm upper receiver.

Referring now to FIG. 23, there is shown a side view of a 5.56 mm upper receiver 270 in accordance with another exemplary embodiment. Whereas exemplary upper receivers 230, 250 described previously may interface with separate adapter 190 to couple to common lower receiver 44 upper receiver 270 in the exemplary embodiment shown in FIG. 23, may couple with lower receiver 44 without separate adapter 190. In the embodiment shown, 5.56 mm upper receiver 270 is shown with an integral adapter portion 272 that may be an assembly or may be of unitary construction. In an assembly, the portion 272 may be mounted or assembled to the frame of the upper receiver using integral fasteners such as keys or "snap on" fastening systems (e.g. detents and receptacles) and no separate removable fasteners). In the exemplary embodiment shown, the upper receiver 270 has frame 274 where the upper receiver is shown of unitary construction, including an integral hand guard. Upper receiver housing 270 is shown as features substantially similar to a 5.56 mm compatible upper receiver housing for a black rifle type firearm but with integral adapter portion 272. Lug 276 has a bore that interfaces with the rear hole 70 in lower receiver 44 and engages pin 68 to couple the rear portion of housing 270 to lower receiver 44. Lug 280 of upper receiver housing 270 has a bore that interfaces with the front bore 70 of lower receiver 44. As such the front portion of 5.56 mm upper receiver housing 270 is coupled to the lower receiver 44.

Figure 24:
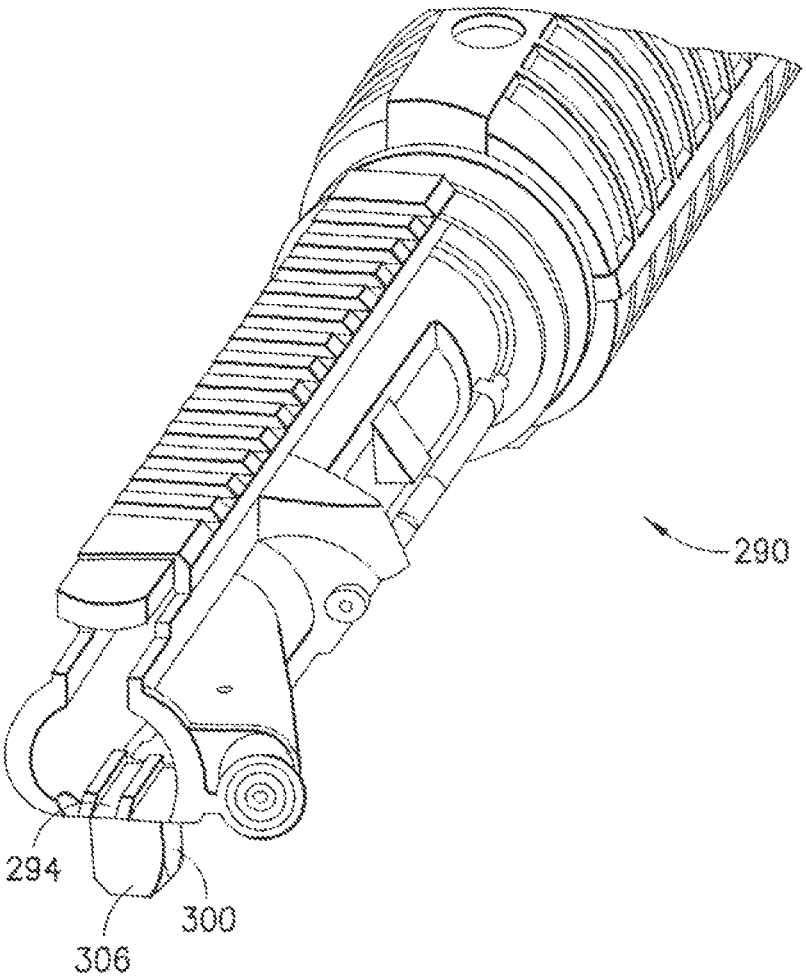
FIG. 24 is an isometric view of an upper receiver.
Figure 25:
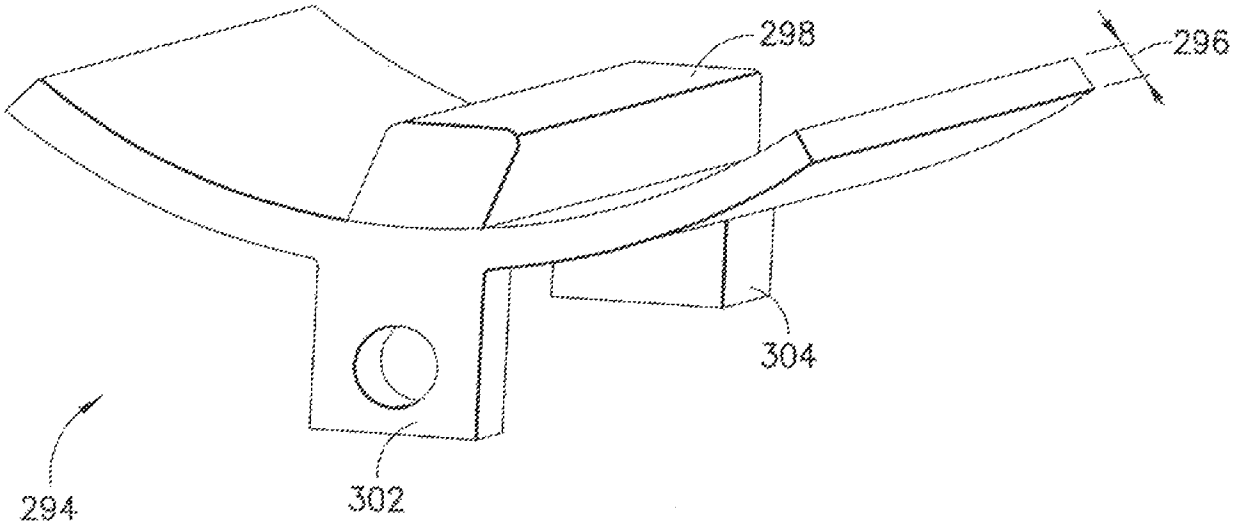
FIG. 25 is an isometric view of a skid plate.

Referring now to FIG. 24, there is shown an isometric view of an exemplary upper receiver 290 where upper receiver 290 may be of any suitable caliber. An insert or skid plate 294 may be installed and may be used with any caliber upper receiver. Skid plate 294 may be of steel or any suitable material and may be inserted, for example, within an aluminum upper receiver housing. Skid plate 294 may function as a guide and may be provided for ease of manufacture. Referring also to FIG. 25, there is shown an isometric view of skid plate 294. Skid plate 294 may have thickness 296, for example, 0.030" thick and having a center rib 298. Here, rib 298 may be provided to interface with a mating groove in the skid surface on the bottom of the rear end of a bolt carrier (i.e. for example FIG. 15D)). Alternately, rib 298 may not be provided, for example, with a bolt carrier having a rounded bottom at the rear. The thickness 296 of skid plate 294 is mounted within recess 300 of upper receiver 290. Skid plate 294 further has lugs 302, 304 that are retained on opposing portions of upper receiver lug 306 preventing skid plate 294 from moving. Alternately, skids on the bolt carrier may be removed and the skid plate forms a skid surface positioned to eliminate the possibility of the bolt carrier binding in the buffer tube (receiver extension) caused by misalignment of the buffer tube and the upper receiver. In the embodiment shown, skid plate 294 is shown positioned in upper receiver 290 to engage the bottom rear of the bolt carrier where skid plate 294 corrects any carrier tilt as the carrier moves rearward during action operation. Thus, the skids present on conventional bolt carriers are removed and the skid plate elevates the bolt carrier riding thereon and eliminates the binding of the carrier in the buffer tube (receiver extension) caused by misalignment of the buffer tube and the upper receiver. Such misalignment may be caused by tolerance stackup between the upper receiver, lower receiver, lower receiver threads, buffer tube threads, and the buffer bore.

Figure 26:
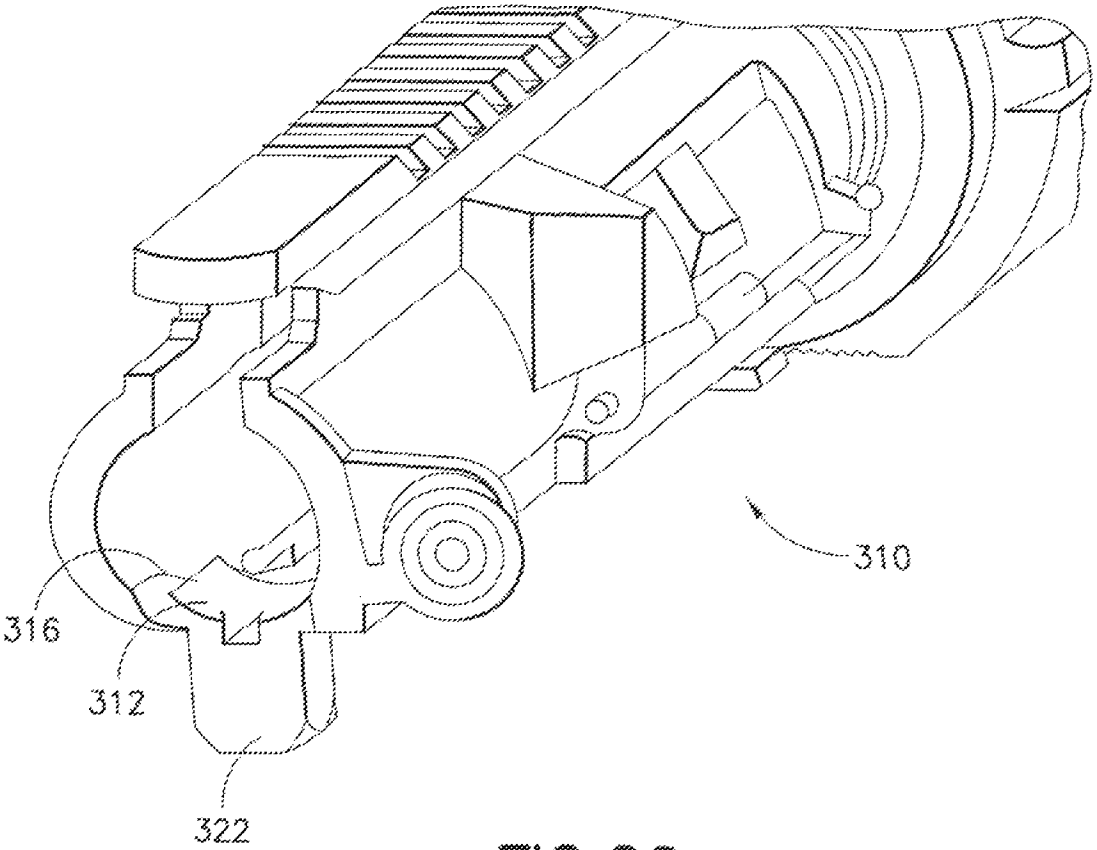
FIG. 26 is an isometric view of an upper receiver.
Figure 27:
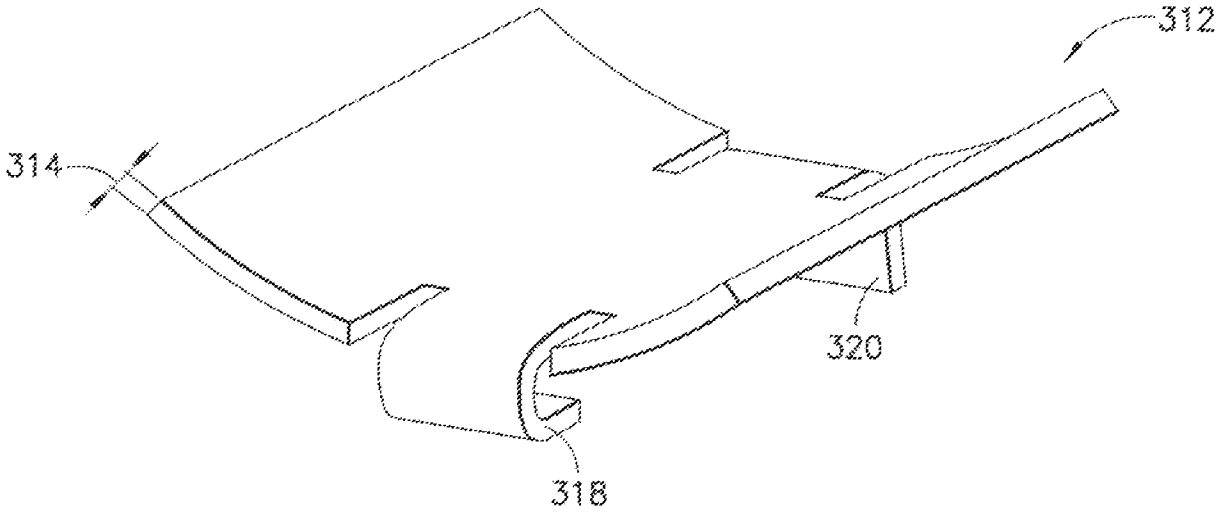
FIG. 27 is an isometric view of a skid plate.

Referring now to FIG. 26, there is shown an isometric view of an upper receiver 310 showing an alternate embodiment skid plate 312. Referring also to FIG. 27, there is shown an isometric view of skid plate 312. Skid plate 312 may have thickness 314, for example, 0.030" thick or otherwise. The thickness 296 of skid plate 294 is mounted on inner surface 316 of upper receiver 310. Skid plate further has lugs 318, 320 that are retained on opposing portions of upper receiver lug 322 preventing skid plate 310 from moving.

Figure 28:
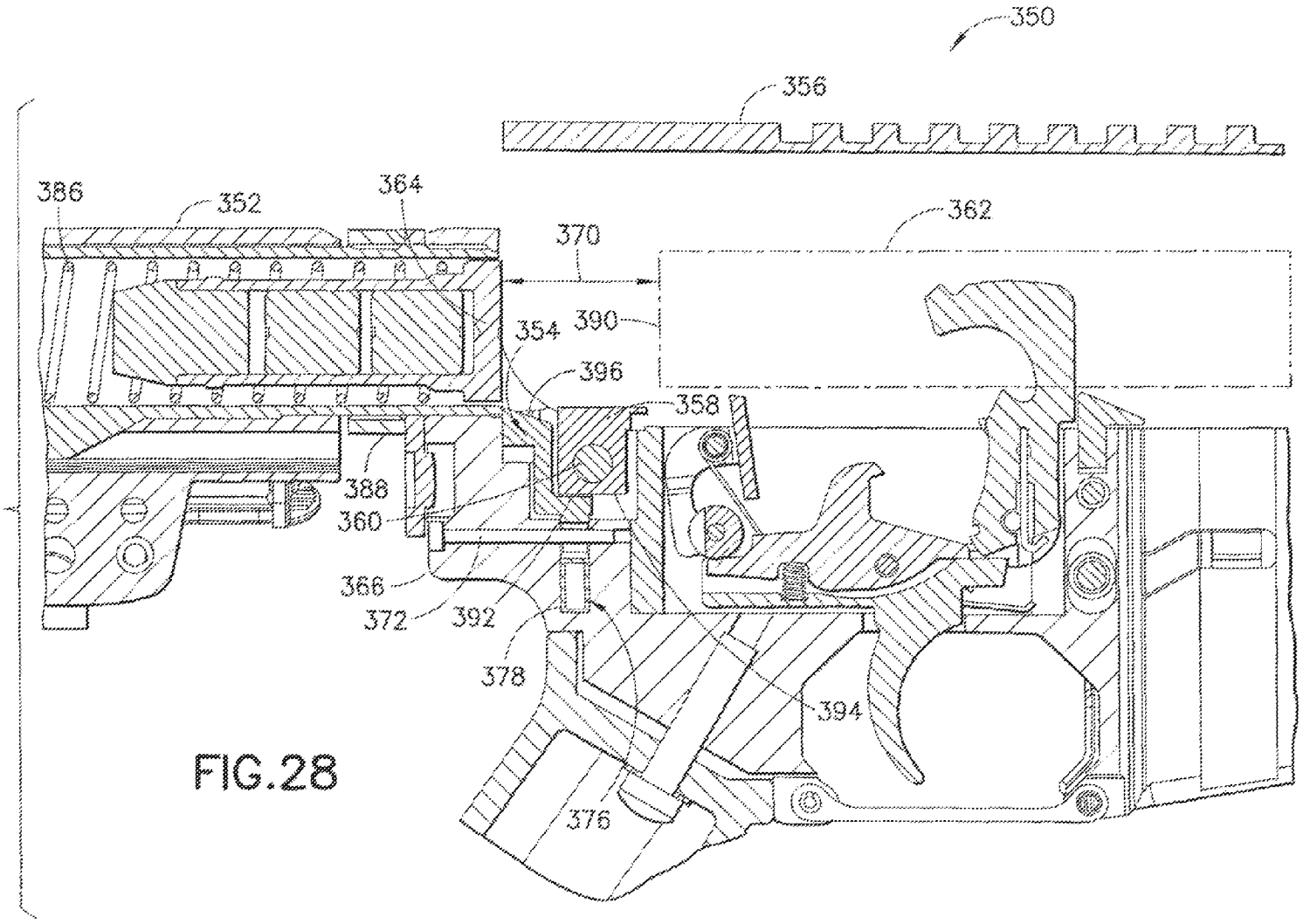
FIG. 28 is a section view of a firearm.
Figure 29:
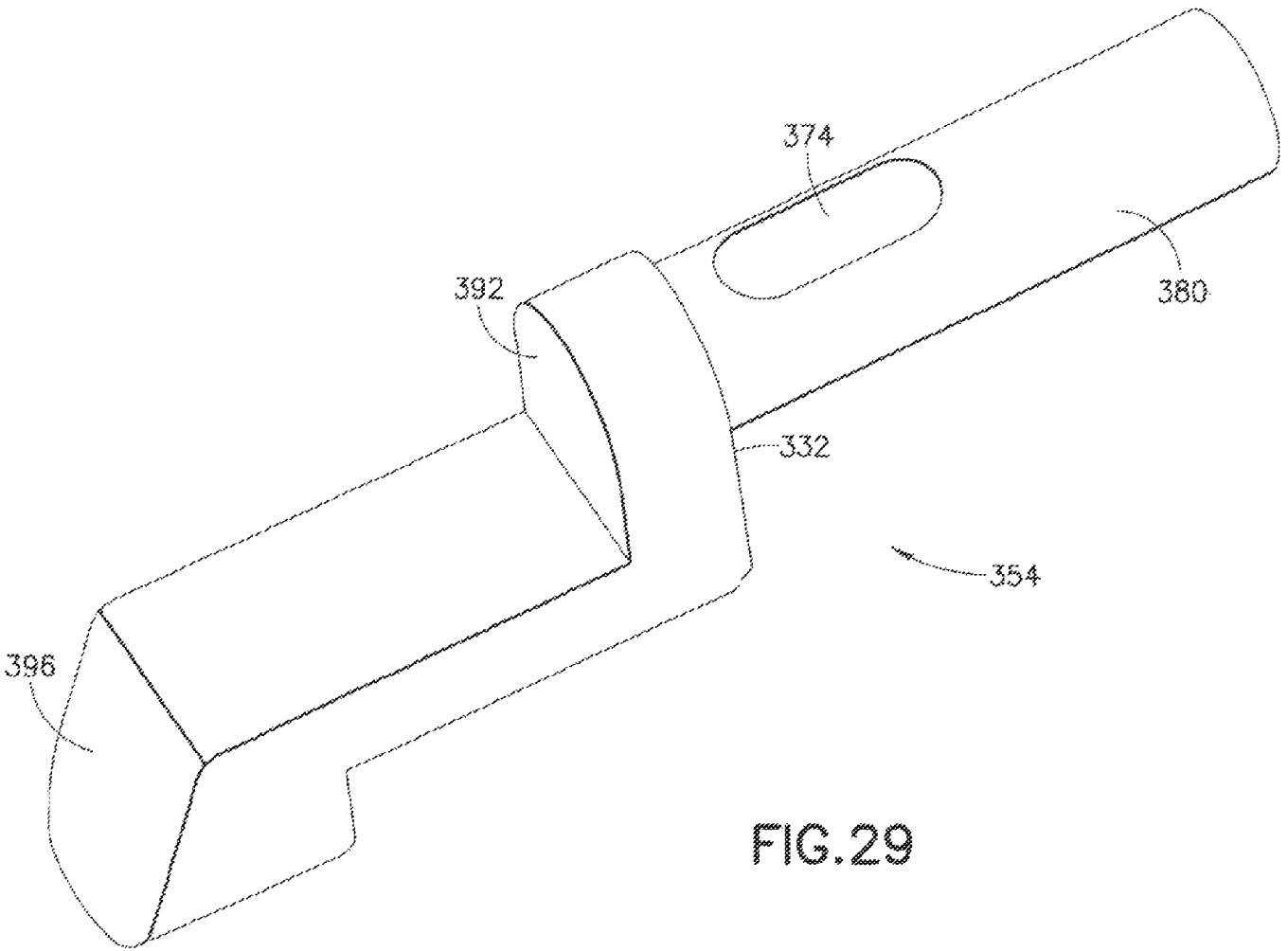
FIG. 29 is an isometric view of a buffer detent.
Figure 30:
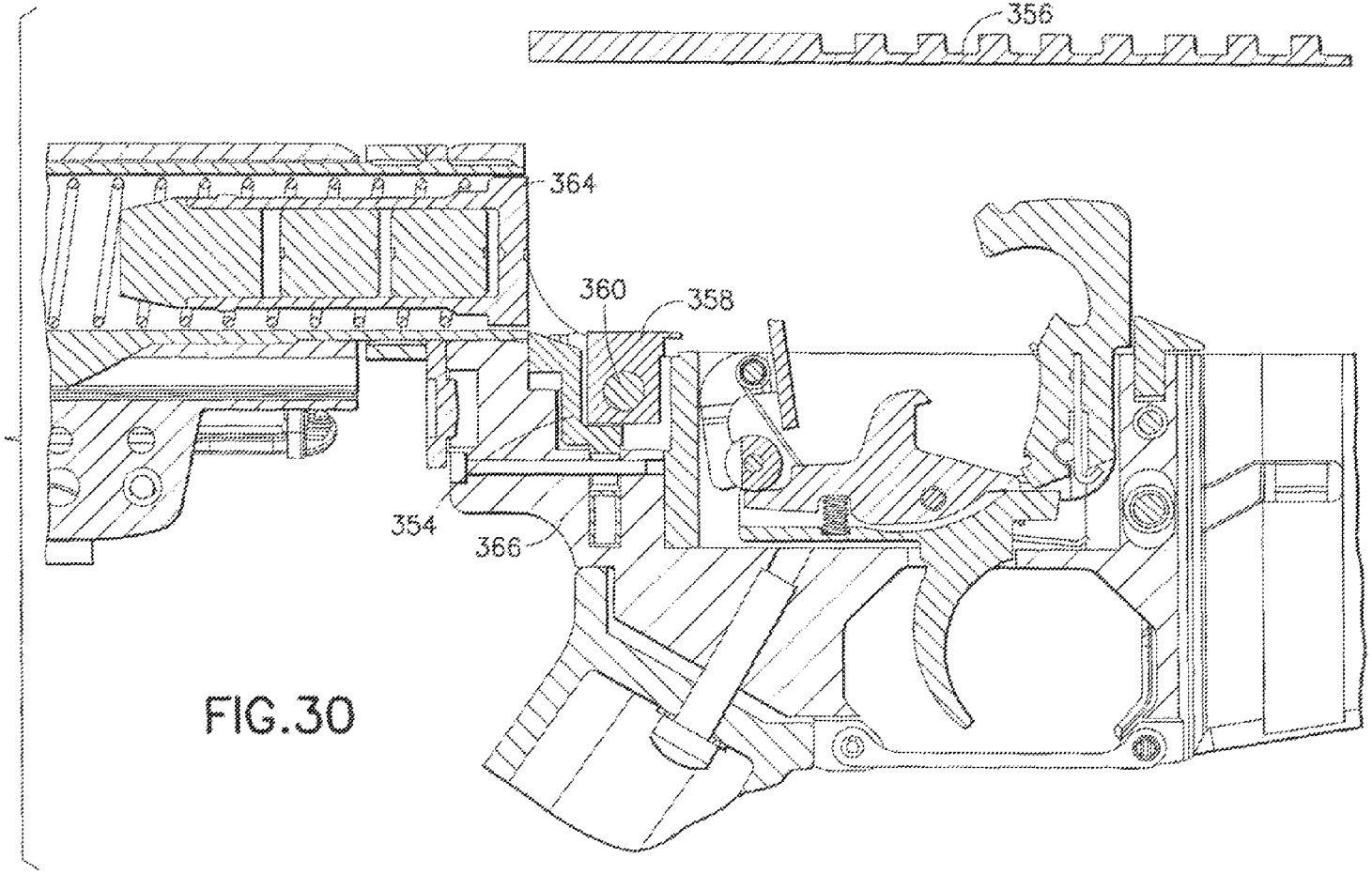
FIG. 30 is a section view of a firearm.
Figure 31:
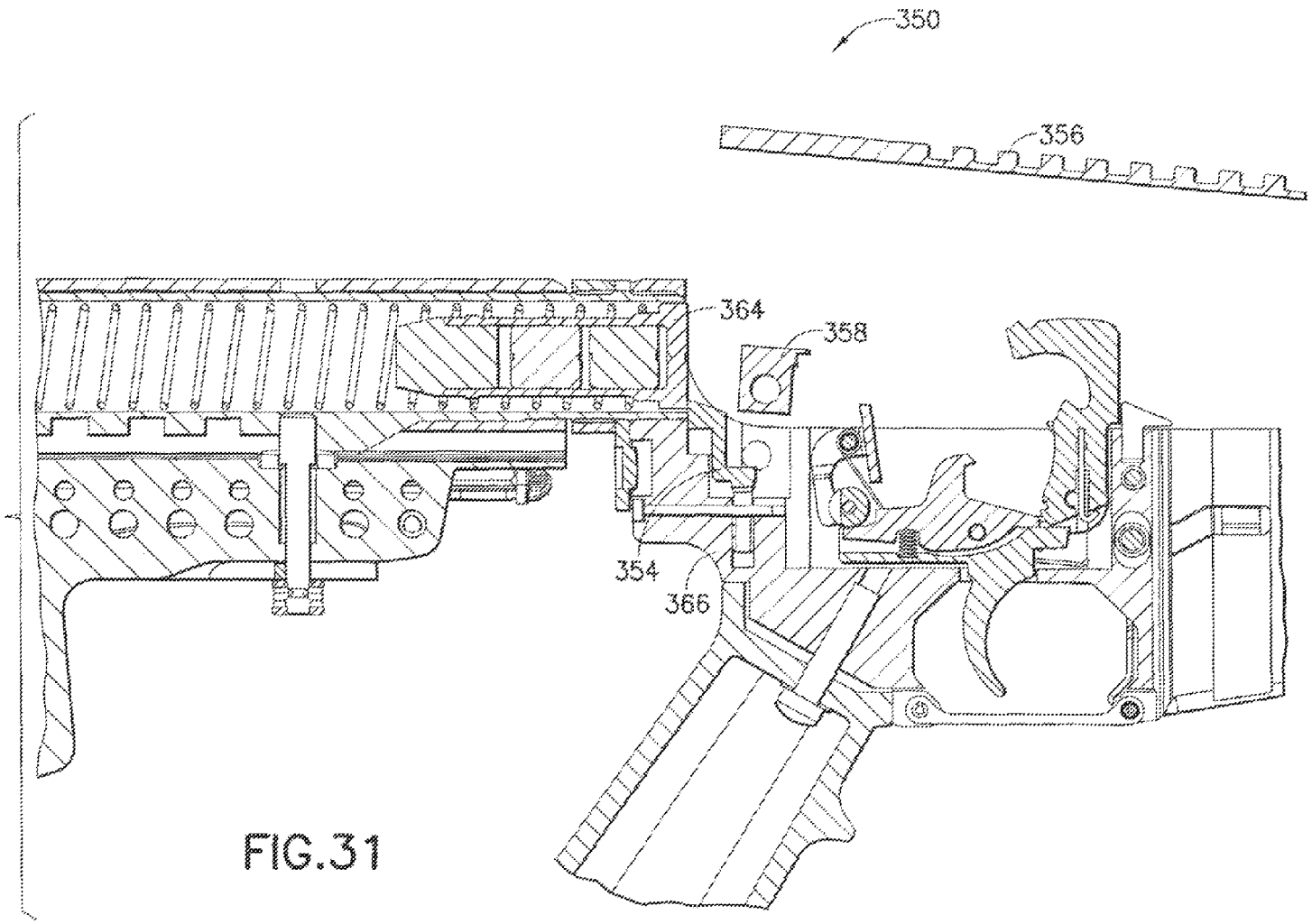
FIG. 31 is a section view of a firearm.

Referring now to FIG. 28, there is shown a section view of a firearm 350 having a common buffer 352. Accordingly, in the exemplary embodiment different interchangeable upper receiver assembly modules may be swapped onto the common lower receiver (similar to lower receiver 44) as previously described, and without changing buffer components, such as springs or otherwise. Referring now to FIG. 29, there is shown an isometric view of buffer detent 354 in accordance with an exemplary embodiment. Referring also to FIG. 30, there is shown a section view of a firearm 350 with the upper and lower receivers in a closed position. Referring also to FIG. 31, there is shown a section view of firearm 350 with the rifle partially opened. Except as otherwise described below the upper and lower receivers of firearm 350 are substantially similar to the upper and lower receivers of firearm 10. A retractable/automatic buffer detent 354 is provided and held down by upper receiver 356 rear lug 358 when the upper receiver is in the closed position. Removing takedown pin 360 by pushing takedown pin 360 out allows detent 354 to open the rifle a small amount so that retracting bolt carrier assembly 362 will automatically open the rifle when buffer 364 is behind detent 354 (See FIG. 31) and lined up with the rear of the rifle. With detent 354 pushing on the upper receiver 356 when upper receiver 356 is pinned to lower receiver 366, force is applied from shoulder surface 392 of detent 354 to rear lug 358 removing any play in the pin holes in the lower and upper receiver for take down pin 360 (See FIG. 30). With a shortened bolt carrier 362 a distance 370 that the buffer needs to be held back in order to open receiver 356 is provided by detent 354 retaining buffer 364. Buffer detent retaining pin 372 is provided in mating slot 374 of detent 354 to retain detent 354 within lower receiver 366. Buffer detent spring 376 is provided within bore 378 of lower receiver 366 and surrounds post 380 of detent 354 and when compressed presses against shoulder 382 of detent 354 to provide the upward force. In this manner, a common buffer system 352 having a common spring 386 and buffer 364 is located on a common lower receiver extension 388 for more than one upper receiver. Common buffer system 352 enables a "conformal" buffer system and may extend the buffer 362 and spring 386 beyond the front face of the extension tube and rear end of the upper receiver to engage the bolt carrier end inside the upper receiver during operation. By way of example, a 7.62 mm (and other calibers >5.56 mm) bolt carrier may be shortened so that stroke is accommodated, at least in part within the upper receiver. For example, the length of a 7.62 mm bolt carrier may be shortened, to be generally similar to the length of a 5.56 mm bolt carrier where the bolt carrier length may be shortened by reducing the length of the bolt carrier rear portion (similar to rear portion 13D in FIG. 9A). In alternate embodiments, any suitable caliber or bolt carrier may be provided where the length of the bolt carriers may be varied as desired where conformance engagement by the buffer system may allow the bolt carrier length (including 5.56 mm carrier) to vary as desired. Further, conformance engagement may allow a common buffer and main spring to be used with more than one of bolt carrier type and for example with all bolt carrier types. In the embodiment shown, an actuable buffer retainer and detent system is incorporated to replace the conventional static buffer retainer and detent of a conventional black rifle configuration where the actuable buffer detent is automatic and is spring loaded. When detent 354 is in the deployed (extended) position (see FIG. 31), detent 354 retains buffer system 352 substantially flush at the extension tube rear end upper receiver interface, allowing upper receiver 356 to be removed and disengaged from lower receiver 366. In the closed position (see FIG. 30), detent 354 allows buffer system 352 to conformally engage bolt carrier 362, for example, to extend outside of extension tube into or to maintain contact with bolt carrier 362, for example at portion 390. Buffer detent 354 is shown positioned between deployed and retracted positions by upper receiver 356. In the embodiment shown, contact surface 394 on rear pin lug 358 engages detent 354 where detent 354 is automatically closed when closing upper receiver 356 and automatically released when opening upper receiver 356. Partial release may occur to facilitate retraction of buffer 364 via cycling of bolt carrier 362 with charging handle, followed by full release to the deployed position when upper receiver 356 is opened. Bias of spring loaded detent 354 against upper receiver 356 may eliminate any undesired play and associated noises between the upper and lower receiver. Further, upon removal of takedown pin 360, detent 354 may automatically commence opening upper receiver 356 and retraction of bolt 362 via the charging handle will release buffer detent 354. In alternate embodiments, any suitable configuration may be used for the detent. Caroming and ramped surface 396 may be provided on a front portion of detent 354 that may aid retraction of buffer 364 with detent 354 in a partial deployed position.

In accordance with one exemplary embodiment, a modular automatic or semiautomatic rifle is provided. The rifle has a lower receiver assembly having a fire control assembly for firing the rifle. An upper receiver assembly is provided with a frame and a bolt carrier assembly configured for firing bullets of a predetermined caliber. The lower receiver has a mating interface configured for operably joining the lower receiver assembly to the upper receiver assembly, and for operably joining the lower receiver assembly to another upper receiver assembly different from the upper receiver assembly configured for firing bullets of the predetermined caliber. The other upper receiver assembly has a different frame and different bolt carrier assembly configured for firing bullets of a different predetermined caliber.

In accordance with another exemplary embodiment, a modular automatic or semiautomatic rifle is provided. The rifle has an upper receiver assembly having a bolt carrier assembly and a barrel. A lower receiver assembly is provided connectable to the upper receiver assembly and having a fire control assembly. The upper receiver assembly is selectable from different interchangeable upper receiver assemblies, each having a different predetermined characteristic determining a different predetermined caliber of bullets capable of being fired by the rifle.

In accordance with another exemplary embodiment, a modular automatic or semiautomatic rifle is provided. The rifle has an upper receiver assembly having a frame and a bolt carrier assembly, the upper receiver assembly configured for firing bullets of a predetermined caliber. A lower receiver assembly is provided connectable to the upper receiver assembly and having a fire control assembly, the lower receiver assembly having a mating interface configured for operably joining the lower receiver assembly to the upper receiver assembly. An adapter is provided connectable to the mating interface, the adapter mating the lower receiver assembly to another upper receiver assembly different from the upper receiver assembly configured for firing bullets of the predetermined caliber, the other upper receiver assembly having a different frame and a different bolt carrier assembly configured for firing bullets of a different predetermined caliber.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A modular automatic or semiautomatic rifle comprising;

a common lower receiver assembly having a fire control assembly for firing the rifle; and an upper receiver assembly with a frame, a first barrel and a bolt carrier assembly configured for bullets of a predetermined caliber;

wherein the common lower receiver assembly has a mating interface configured for operably joining the common lower receiver assembly to the upper receiver assembly, and for operably joining the common lower receiver assembly to another separate upper receiver assembly different from the upper receiver assembly configured for firing bullets of the predetermined caliber, the another separate upper receiver assembly having a different frame, a different barrel and a different bolt carrier assembly configured for firing bullets of a different predetermined caliber, wherein the predetermined caliber is 7.62×51 mm and the different predetermined caliber is 5.56×45 mm, wherein the common lower receiver assembly has a front portion having a configuration for the upper receiver assembly and a rear portion having a configuration for the another separate upper receiver assembly and wherein the front portion and the rear portion are formed from a one-piece unitary construction and wherein the front portion has a magazine well that is used for both the upper receiver assembly and the another separate upper receiver assembly.

2. The modular automatic or semiautomatic rifle of claim 1, wherein the magazine well of the front portion accepts a NATO 7.62 mm magazine and wherein the rear portion has a receiver extension compatible with a NATO 5.56 mm bolt carrier.

3. The modular automatic or semiautomatic rifle of claim 1 further comprising an adapter, the adapter coupling the another separate upper receiver assembly to the common lower receiver assembly.

4. The modular automatic or semiautomatic rifle of claim 1 wherein the upper receiver assembly and the common lower receiver assembly are joined with pins.

5. The modular automatic or semiautomatic rifle of claim 1 wherein the common lower receiver assembly further comprises a buffer having a spring, wherein the buffer requires a different spring when the another separate upper receiver assembly is joined to the assembly.

6. The modular automatic or semiautomatic rifle of claim 1 further comprising an adapter, the adapter coupling the another separate upper receiver assembly to the common lower receiver assembly, the adapter having an interior portion adapted to accept a magazine of the different predetermined caliber.

7. A modular automatic or semiautomatic rifle comprising;

an upper receiver assembly having a bolt carrier assembly and a barrel; and a common lower receiver assembly connectable to the upper receiver assembly and having a fire control assembly;

wherein the upper receiver assembly is selected from a group of separate upper receiver assemblies, the group of separate upper receiver assemblies comprising at least a first upper receiver having a first frame, a first bolt barrier assembly and a first barrel configured for use with a first caliber of bullets and a second upper receiver having a second frame, a second bolt carrier and a second barrel configured for use with a second caliber of bullets, the first caliber of bullets being different from the second caliber of bullets, wherein the first caliber of bullets are 7.62×51 mm and the second caliber of bullets are 5.56×45 mm, wherein the common lower receiver assembly has a front portion having a configuration for the first upper receiver and a rear portion having a configuration for the second upper receiver and wherein the front portion and the rear portion are formed from a one-piece unitary construction and wherein the front portion has a magazine well that is used for both the first upper receiver and the second upper receiver.

8. The modular automatic or semiautomatic rifle of claim 7, wherein the magazine well of the front portion accepts a NATO 7.62 mm magazine and wherein the rear portion has a receiver extension compatible with a NATO 5.56 mm bolt carrier.

9. The modular automatic or semiautomatic rifle of claim 7 wherein the group of separate upper receiver assemblies has a different interchangeable adapter, each of the different interchangeable adapters coupling each one of the group of separate upper receiver assemblies to the common lower receiver assembly.

10. The modular automatic or semiautomatic rifle of claim 7 wherein the upper receiver assembly and the common lower receiver assembly are joined with pins.

11. The modular automatic or semiautomatic rifle of claim 7 wherein the common lower receiver assembly further comprises a buffer having a spring for use with the first upper receiver when it is secured to the common lower receiver assembly, and wherein the buffer requires a different spring for use with the second upper receiver when it is secured to the common lower receiver assembly.

12. The modular automatic or semiautomatic rifle of claim 7 wherein each of the different interchangeable upper receiver assemblies has a different interchangeable adapter, each of the different interchangeable adapters coupling each of the different interchangeable upper receiver assemblies to the common lower receiver assembly, each of the adapters having an interior portion adapted to accept a magazine of each of the different predetermined calibers.

13. A modular automatic or semiautomatic rifle comprising;

an upper receiver assembly having a frame, a barrel and a bolt carrier assembly, the upper receiver assembly configured for firing bullets of a predetermined caliber;

a common lower receiver assembly connectable to the upper receiver assembly and having a fire control assembly, the common lower receiver assembly having a mating interface configured for operably joining the common lower receiver assembly to the upper receiver assembly; and an adapter connectable to the mating interface, the adapter mating the common lower receiver assembly to another separate upper receiver assembly different from the upper receiver assembly configured for firing bullets of the predetermined caliber, the another upper receiver assembly having a different frame, a different barrel and a different bolt carrier assembly configured for firing bullets of a different predetermined caliber, wherein the first caliber of bullets are 7.62×51 mm and the second caliber of bullets are 5.56×45 mm, wherein the common lower receiver assembly has a front portion having a configuration for the upper receiver assembly and a rear portion having a configuration for the another separate upper receiver assembly and wherein the front portion and the rear portion are formed from a one-piece unitary construction and wherein the front portion has a magazine well that is used for both the upper receiver assembly and the another separate upper receiver assembly.

14. The modular automatic or semiautomatic rifle of claim 13, wherein the magazine well of the front portion accepts a NATO 7.62 mm magazine and wherein the rear portion has a receiver extension compatible with a NATO 5.56 mm bolt carrier.

15. The modular automatic or semiautomatic rifle of claim 13 wherein the upper receiver assembly and the common lower receiver assembly are joined with pins.

16. The modular automatic or semiautomatic of claim 13, wherein the common lower receiver assembly further comprises a buffer having a spring, wherein the buffer requires a different spring when the another separate upper receiver assembly is joined to the common lower receiver assembly.

17. The modular automatic or semiautomatic rifle of claim 13 wherein the adapter has an interior portion adapted to accept a magazine of the different predetermined caliber.

* * * * *